US010221635B2

(12) United States Patent
Ramos

(10) Patent No.: US 10,221,635 B2
(45) Date of Patent: Mar. 5, 2019

(54) SLIDE CARTRIDGE

(71) Applicant: The Charles Machine Works, Inc., Perry, OK (US)

(72) Inventor: Pete Ramos, Enid, OK (US)

(73) Assignee: The Charles Machine Works, Inc., Perry, OK (US)

( * ) Notice: Subject to any disclaimer, the term of this patent is extended or adjusted under 35 U.S.C. 154(b) by 217 days.

(21) Appl. No.: 15/288,505

(22) Filed: Oct. 7, 2016

(65) Prior Publication Data

US 2017/0101832 A1 Apr. 13, 2017

Related U.S. Application Data

(60) Provisional application No. 62/238,348, filed on Oct. 7, 2015.

(51) Int. Cl.

| | |
|---|---|
| ***E21B 19/083*** | (2006.01) |
| ***E21B 19/08*** | (2006.01) |
| ***E21B 3/02*** | (2006.01) |
| ***E21B 7/04*** | (2006.01) |
| *E21B 47/12* | (2012.01) |

(52) U.S. Cl.

CPC ..... *E21B 19/08* (2013.01); *E21B 3/02* (2013.01); *E21B 7/046* (2013.01); *E21B 19/083* (2013.01); *E21B 47/12* (2013.01)

(58) Field of Classification Search

CPC ..... E21B 19/083

See application file for complete search history.

(56) References Cited

U.S. PATENT DOCUMENTS

| | | | | |
|---|---|---|---|---|
| 2,835,472 | A * | 5/1958 | Osborn | E21B 7/046 173/145 |
| 3,919,816 | A * | 11/1975 | Ranft | E21B 7/02 173/195 |
| 4,068,487 | A * | 1/1978 | Pease | B63B 35/4413 104/35 |
| 5,676,061 | A | 10/1997 | Loomer | |
| 6,179,065 | B1 | 1/2001 | Payne et al. | |
| 7,628,226 | B2 | 12/2009 | Mitchell et al. | |
| 2009/0139731 | A1 | 6/2009 | Rieder et al. | |
| 2009/0236164 | A1 | 9/2009 | Pierz | |

(Continued)

FOREIGN PATENT DOCUMENTS

EP 2339108 A1 6/2011

OTHER PUBLICATIONS

Patent Cooperaton Treaty "PCT International Search Report", dated Dec. 22, 2016, 3 pages.

(Continued)

*Primary Examiner* — Giovanna C. Wright

(74) *Attorney, Agent, or Firm* — Tomlinson McKinstry, P.C.

(57) ABSTRACT

A slide cartridge having a base member and a channel defined by a pair of opposed walls. The walls extend from the base member and are configured to partially cover the rail of a horizontal directional drilling machine. The slide cartridge is supported on a carriage that is movable between the front and back of the drilling machine along the rail. The cartridge is positioned to engage the rail and to support the carriage for sliding movement along the rail.

11 Claims, 28 Drawing Sheets

(56) References Cited

U.S. PATENT DOCUMENTS

2013/0000988 A1 1/2013 Lanzl et al.

OTHER PUBLICATIONS

The Charles Machine Works, Inc. "JT100/JT100 All Terrain Operator's Manual", Operator's Manual, 2011, 243 pages, Issue 1.0, Perry, Oklahoma.
Pages from Ditch Witch JT272o parts manual known in the art prior to Oct. 7, 2015, copyright date 2004.
Solid edge drawings of the carriage for the JT2720 known in the art prior to Oct. 7, 2015.
Pages from Ditch Witch JT921 parts manual known in the art prior to Oct. 7, 2015, copyright date 2005.

* cited by examiner

SLIDE CARTRIDGE

CROSS REFERENCE TO RELATED APPLICATION

This application claims the benefit of U.S. Provisional Patent Application Ser. No. 62/238,348 filed on Oct. 7, 2015, the entire contents of which are incorporated herein by reference.

FIELD

This invention relates generally to slide cartridges for horizontal directional drilling machines.

SUMMARY

A slide cartridge comprising a base member, a channel, and a wheel. The channel is defined by a pair of opposed walls that extend from the base member and are configured to partially cover a rail of a horizontal directional drill. The wheel is supported by the base member and has an axis of rotation perpendicular to the channel.

A machine comprising an elongate frame, a rail supported on the frame, a carriage supported on the frame, a slide cartridge, a rotary drive supported on the carriage, and a drill string. The rail has opposed first and second ends. The carriage is supported on the frame and moveable along the rail between the first and second ends. The slide cartridge is mounted on the carriage and configured to guide the carriage along the rail. The slide cartridge comprises a base member and a channel. The channel has a pair of opposed walls that extend from the base member and are configured to engage the rail. The drill string has opposed first and second ends. The first end is operatively connected to the rotary drive.

A machine comprising a carriage frame and a slide cartridge. The carriage frame has a base and a first cantilevered wall attached to the base. The slide cartridge is mounted on the first cantilevered wall. The slide cartridge comprises a base member and a pair of opposed walls. The walls extend from the base member and are configured to define a channel

DESCRIPTION OF THE PREFERRED EMBODIMENTS

This invention is a slide cartridge for use on a carriage of a horizontal directional drilling (hereinafter "HDD") machine, such as the HDD machine 10 shown in FIGS. 24 and 28. The slide cartridge is positioned on the carriage 152, shown in FIG. 24, and partially covers a rail 198 along which the carriage moves between the front and back of the machine 10. The slide cartridge may be used with rollers described in hereinafter that roll along the rail and provide the primary support structure for the carriage on the rail. The slide cartridge may be positioned to engage the rail when, and if, one or more rollers fail. Thus, the slide cartridge may provide a backup support structure for the carriage on the rail to permit continued operation of the HDD machine 10 until the roller(s) are repaired.

Figure 1:
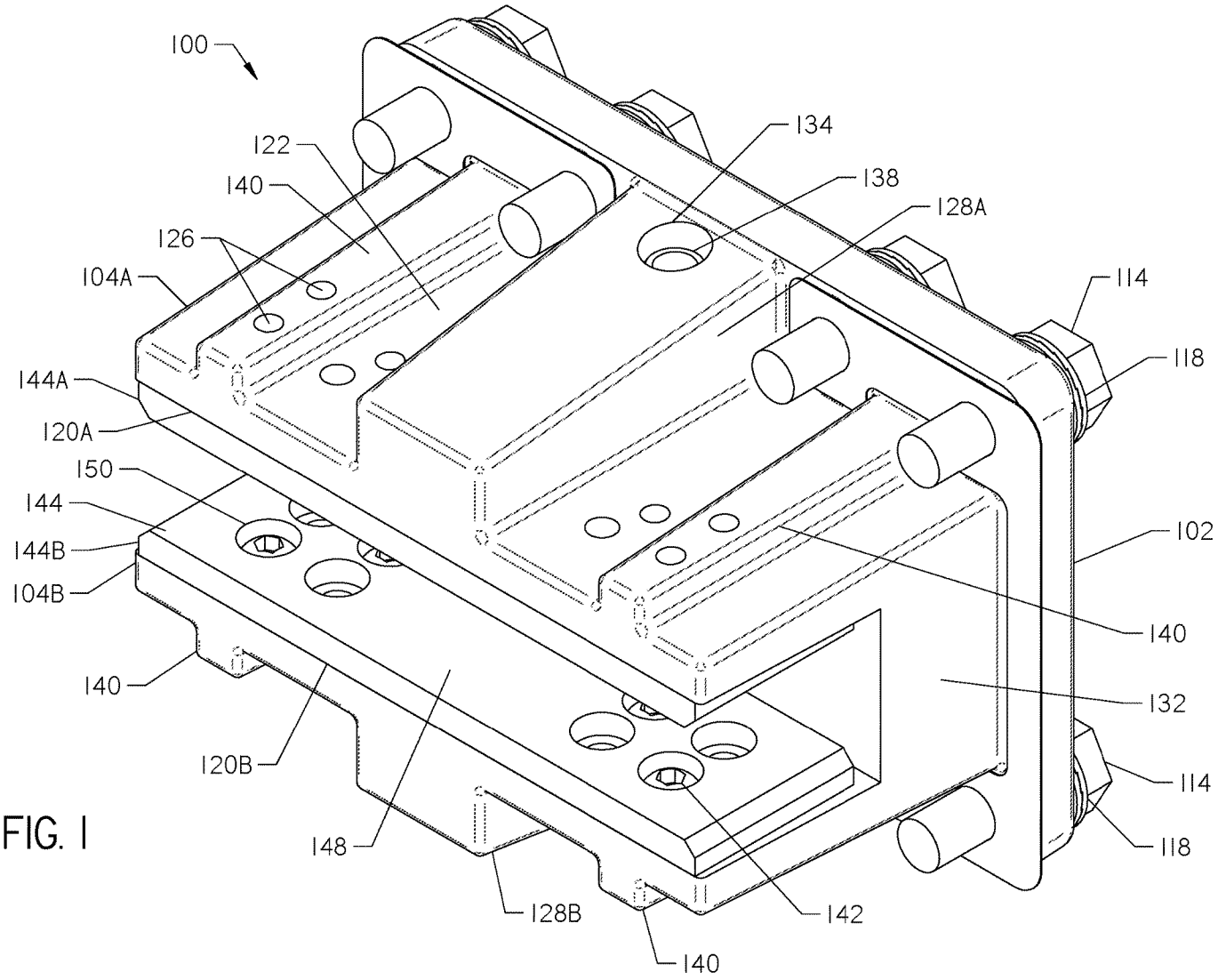
FIG. 1 is a top perspective view of the slide cartridge of the present invention.
Figure 2:
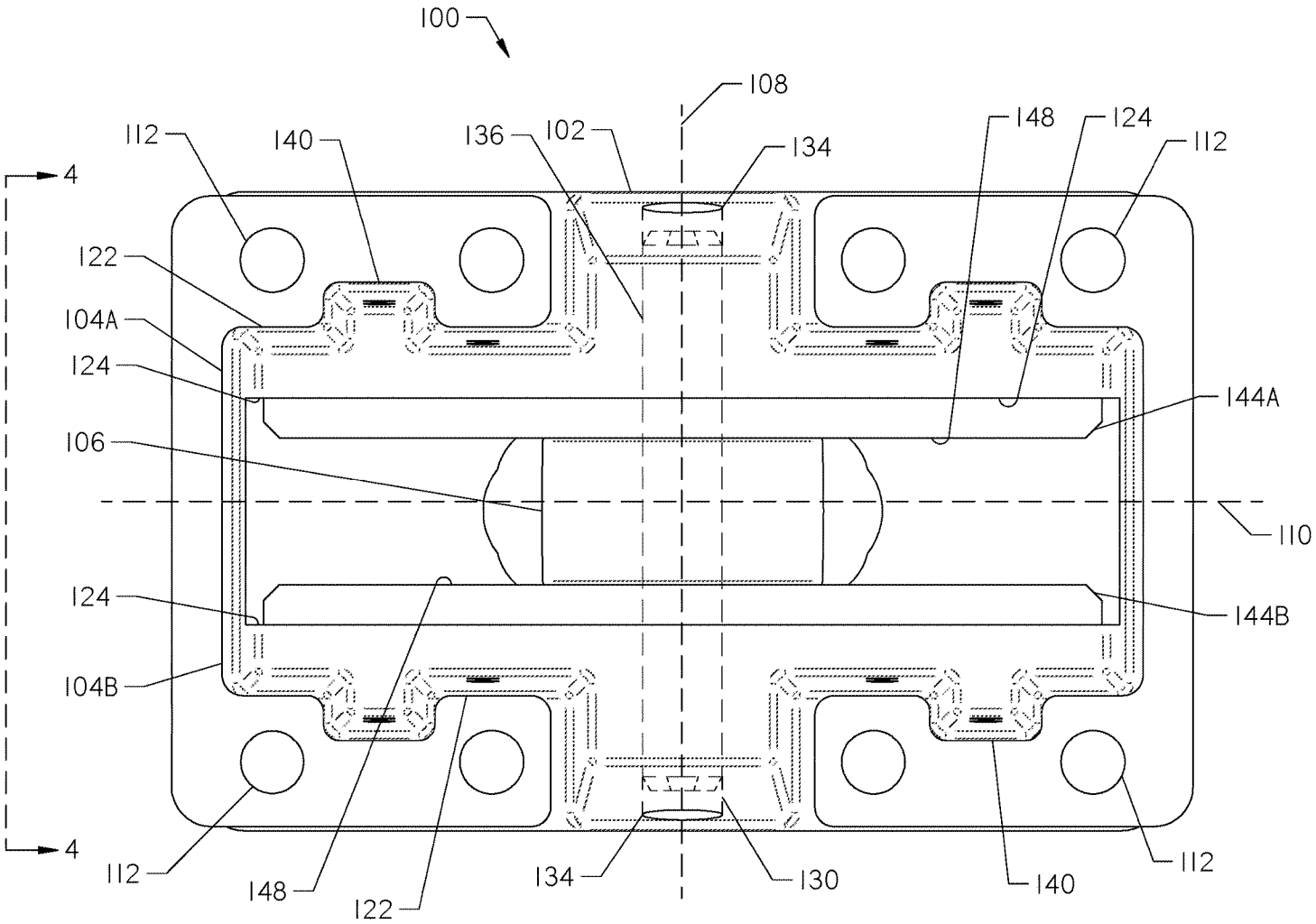
FIG. 2 is a front elevation view of the slide cartridge of FIG. 1 taken along line 2-2 of FIG. 4. A bore through a body of the cartridge is shown in dashed line.
Figure 3:
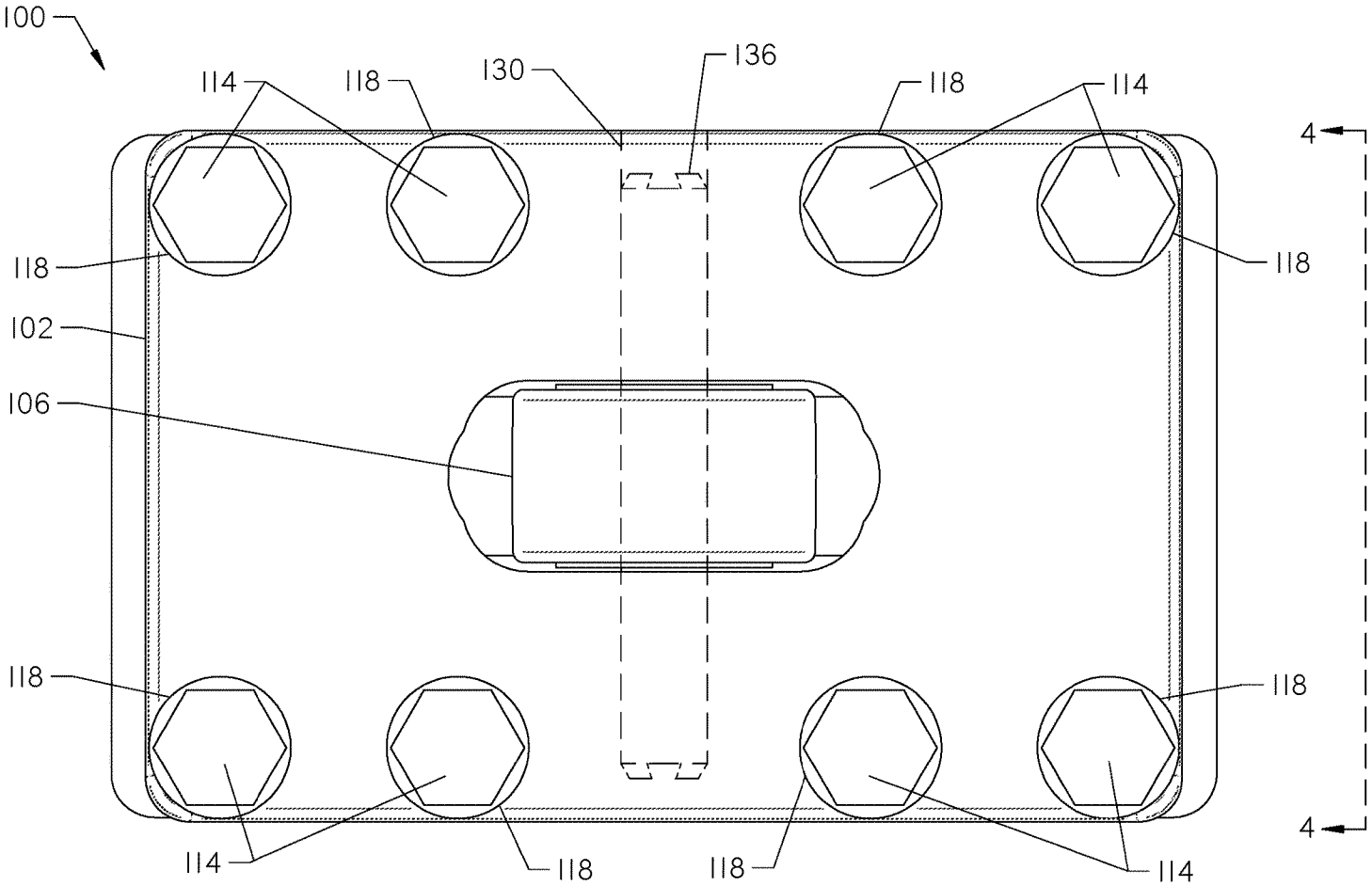
FIG. 3 is a back elevation view of the slide cartridge taken along line 3-3 of FIG. 3. A bore through the body of the cartridge is shown in dashed line.
Figure 4:
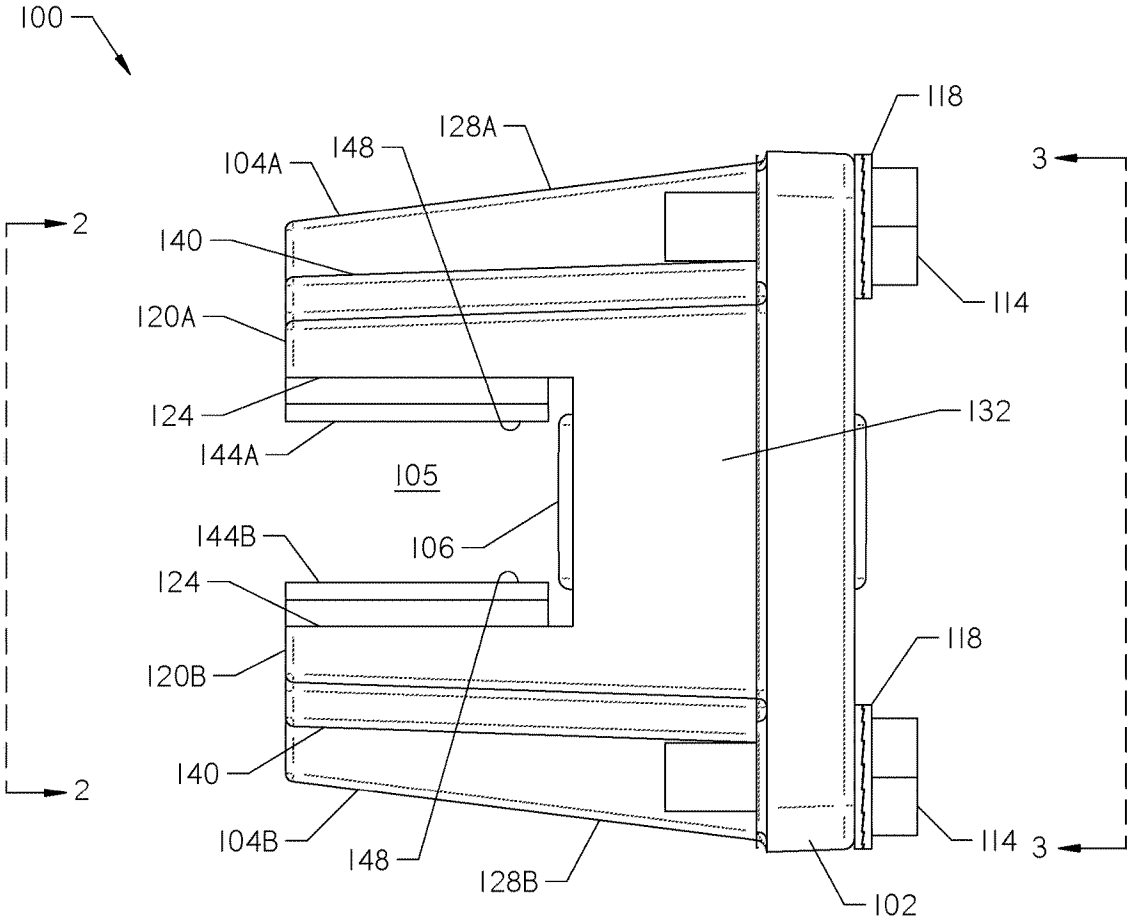
FIG. 4 is a side elevation view of the slide cartridge taken along line 4-4 in FIGS. 2 and 3.
Figure 24:
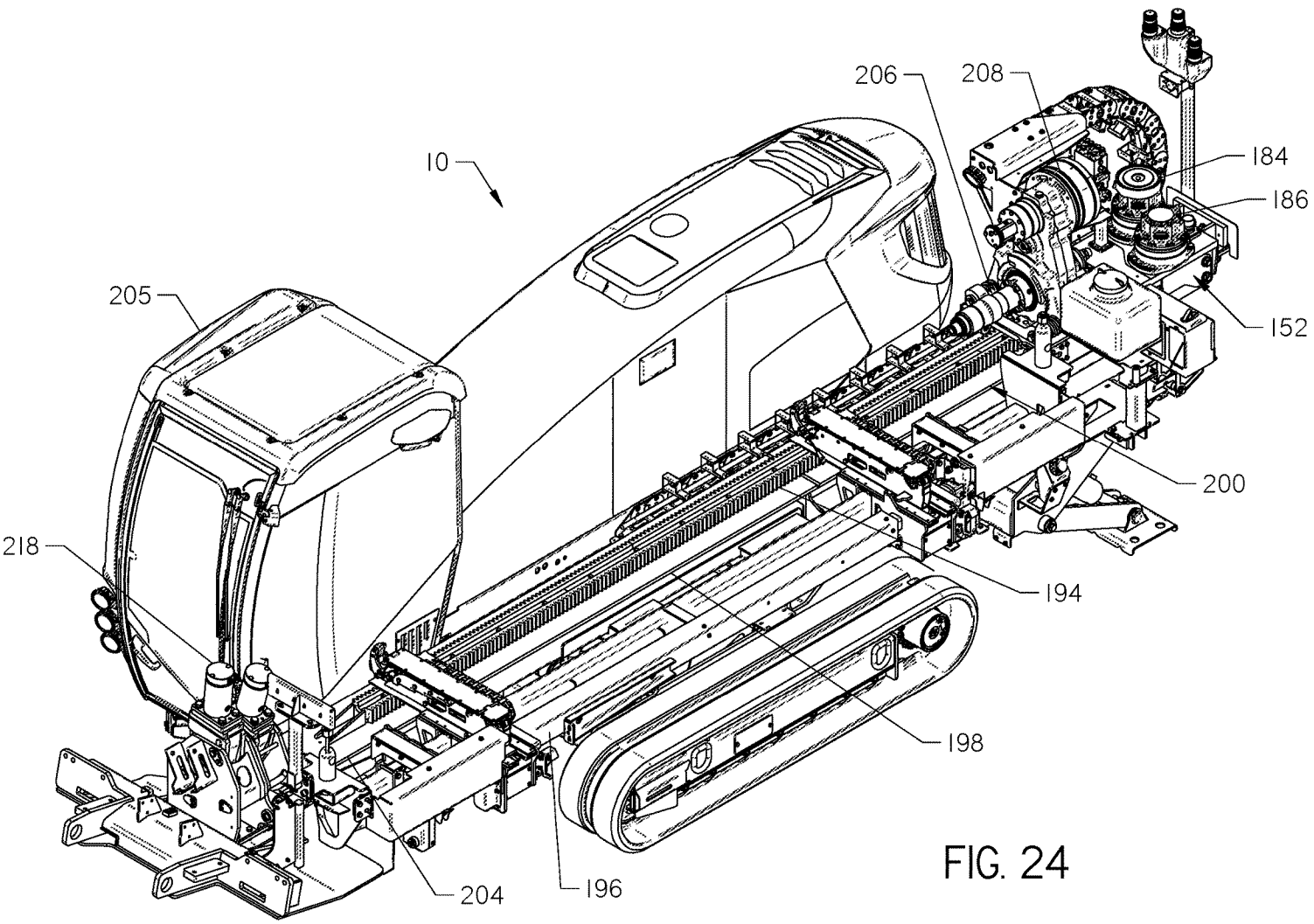
FIG. 24 is a perspective view of a horizontal directional drilling machine having the carriage shown in FIGS. 16-23 supported on the drilling machine frame.

FIGS. 1-8 show a slide cartridge 100 for use with the HDD machine 10 shown in FIG. 24. The cartridge 100 has a base member 102, a pair of opposed walls 104*a-b* that extend from the base member 102, and a wheel 106 supported by the base member. The pair of opposed walls 104*a-b* and the base member 102 define a channel 105 that is configured to partially cover the rail 198 of the HDD machine 10, shown in FIG. 25, in a manner described hereinafter. As shown in FIG. 2, the wheel 106 is supported by the base member 102 so that an axis of rotation 108 of the wheel is perpendicular to a centerline 110 of the Channel 105. As discussed hereinafter, the wheels are positioned to engage an edge of the rail 198, shown in FIG. 25, to limit lateral movement of the carriage 152 relative to the rail.

The base member 102 may be generally rectangular and formed from a single piece of steel or other resilient metal. A plurality of holes 112 may be formed about a periphery of the base member 102, each being sized to receive a fastener 114 used to secure the cartridge 100 to the carriage 152 as shown in FIGS. 16-21. Fasteners 114 may be externally threaded bolts and holes 112 may have corresponding internal threads. In a preferred embodiment, the fasteners may comprise threaded bolts having a hexagonal head. Washers 118 may be positioned between the head of the fastener 114 and the base member 102 to distribute the force exerted by the fasteners on the base member. The base member 102 shown herein has eight (8) holes 112 spaced along the upper and lower edges of the base member. However, the base member may be configured to have a different number of holes 112 depending on the size of the slide cartridge and carriage.

Continuing with FIGS. 1-8, each wall 104*a-b* may be constructed as a separate component. Each wall 104*a-b* may be connected to the base member 102 and cantilevered to have a distal edge 120*a-b* spaced apart from the base member. As shown, the walls 104*a-b* may be supported on the base member 102 so that they are parallel. Further, the walls 104*a-b* may be integrally formed with a body 132 supported on the base member 102. The body 132 may be a generally rectangular piece of metal that is attached to the base member 102. Alternatively, the walls 104*a-b*, body 132, and base member 102 may be cast as a single piece. The walls 104*a-b* may be constructed from a material softer than the steel rail 198, shown in FIG. 24, such as bronze, allowing the walls to he sacrificial in nature, wearing the walls rather than damaging the rail. As discussed below, wear members 144 may be attached to the walls 104*a-b* and constructed from a material softer than the steel rail 198. Use of wear members 144 would allow the walls 104*a-b* to be constructed from a more resilient material such as steel. The body 132 may be welded or attached to the base member 102 by other means.

Figure 9:
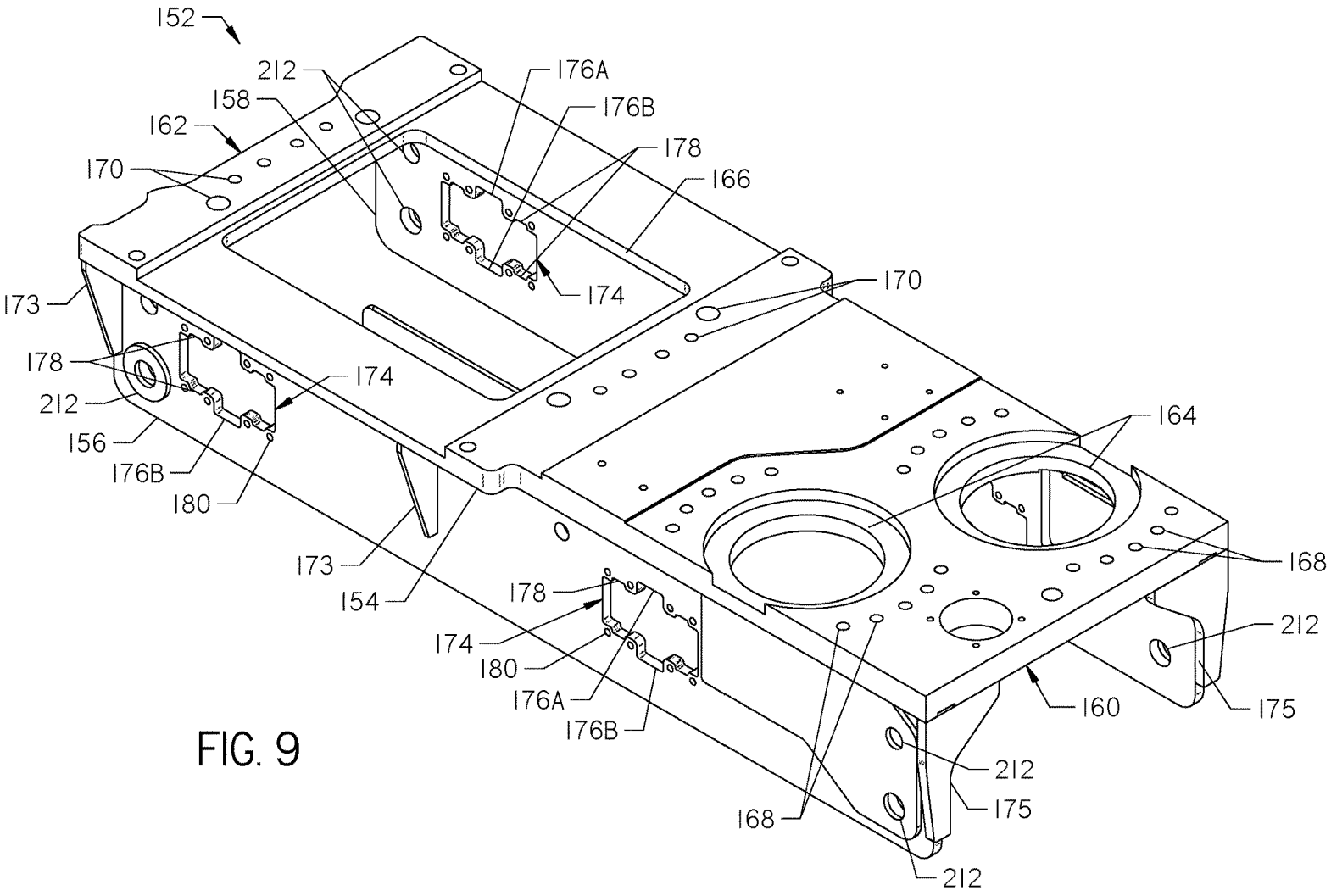
FIG. 9 is a top perspective view of a carriage configured to support the slide cartridge of the present invention, viewed from the outboard side of the carriage.
Figure 10:
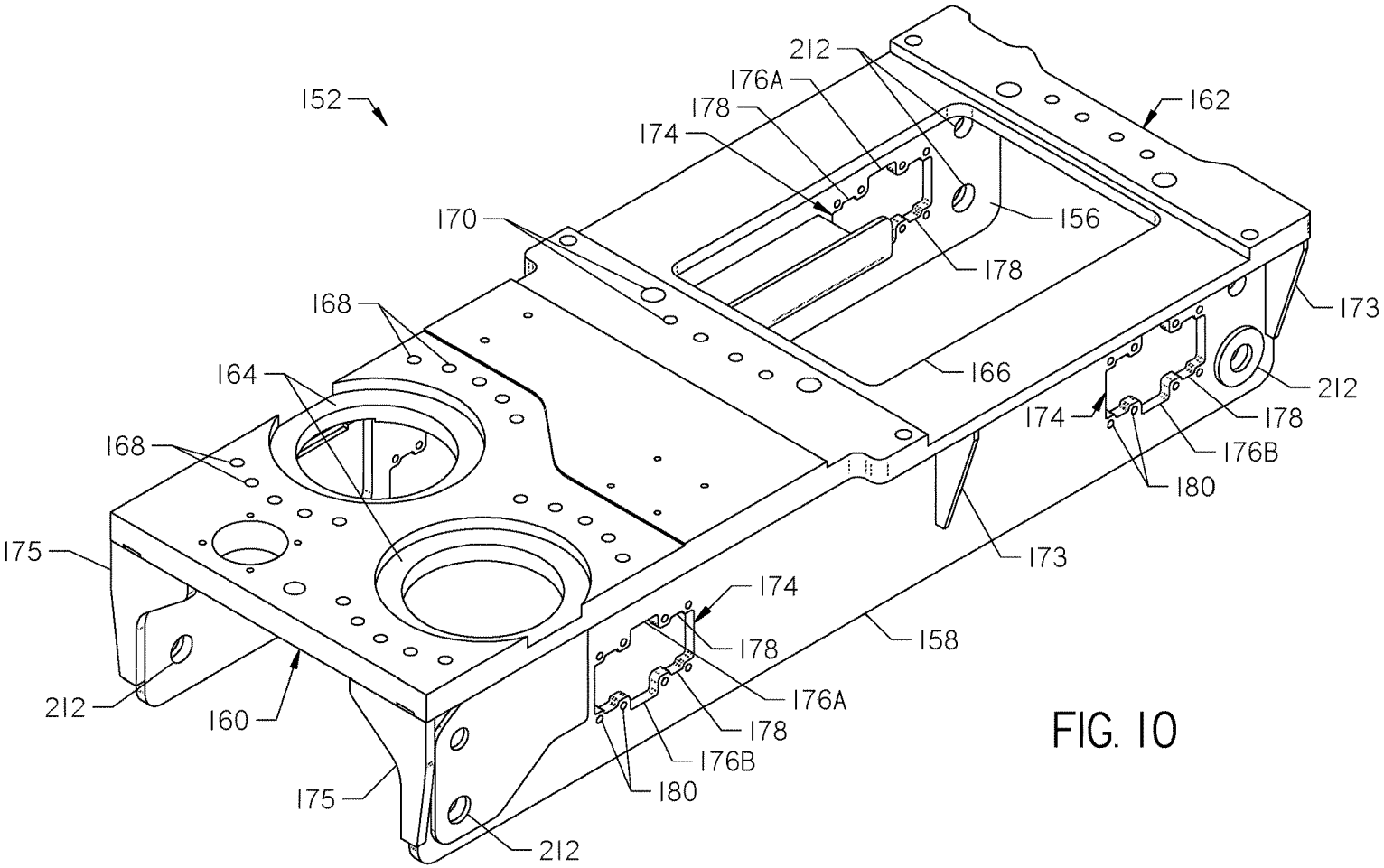
FIG. 10 is a top perspective view of the carriage shown in FIG. 9 showing the inboard side of the carriage.
Figure 11:
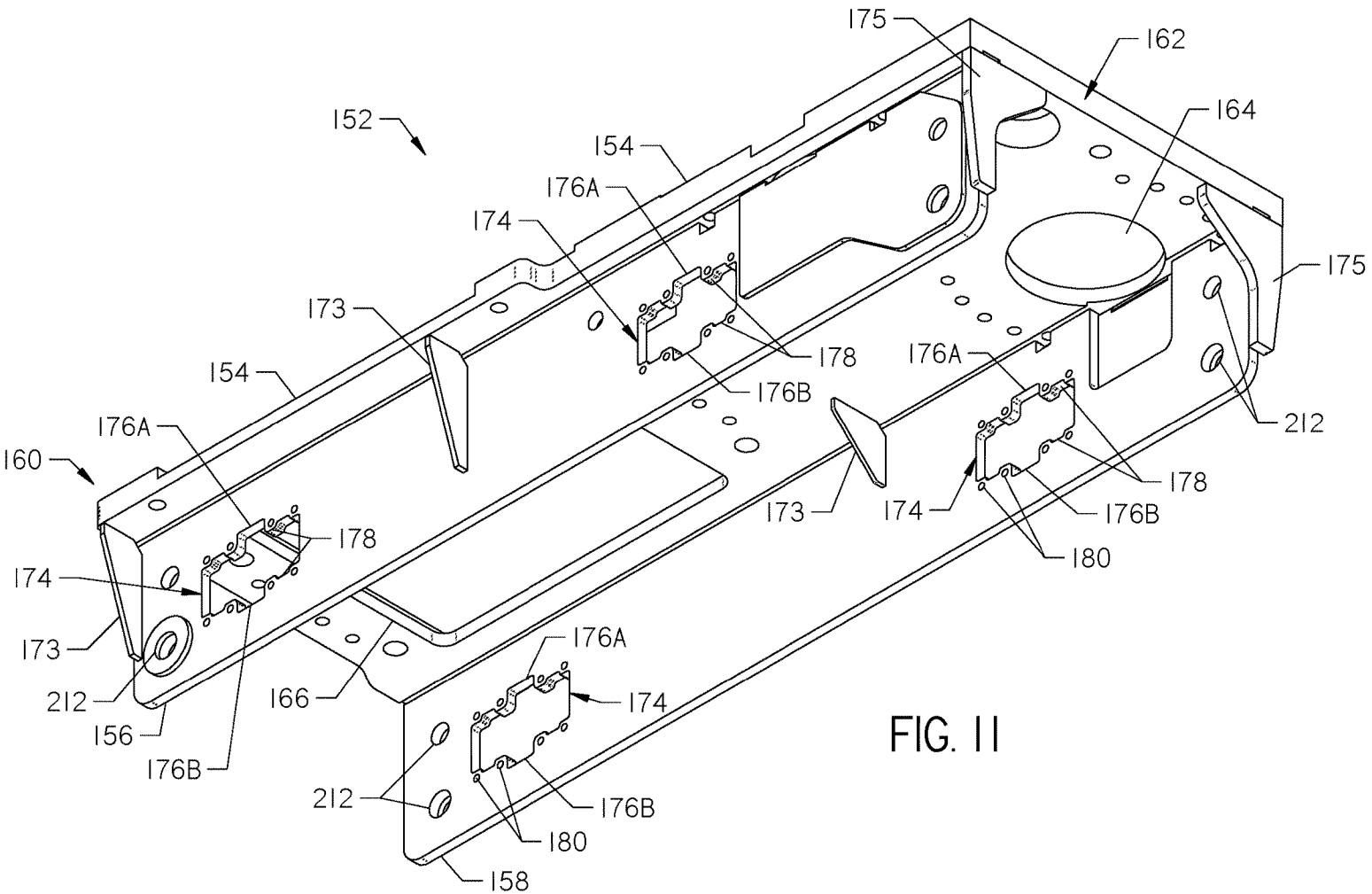
FIG. 11 is a bottom perspective view of the carriage of FIG. 9.
Figure 12:
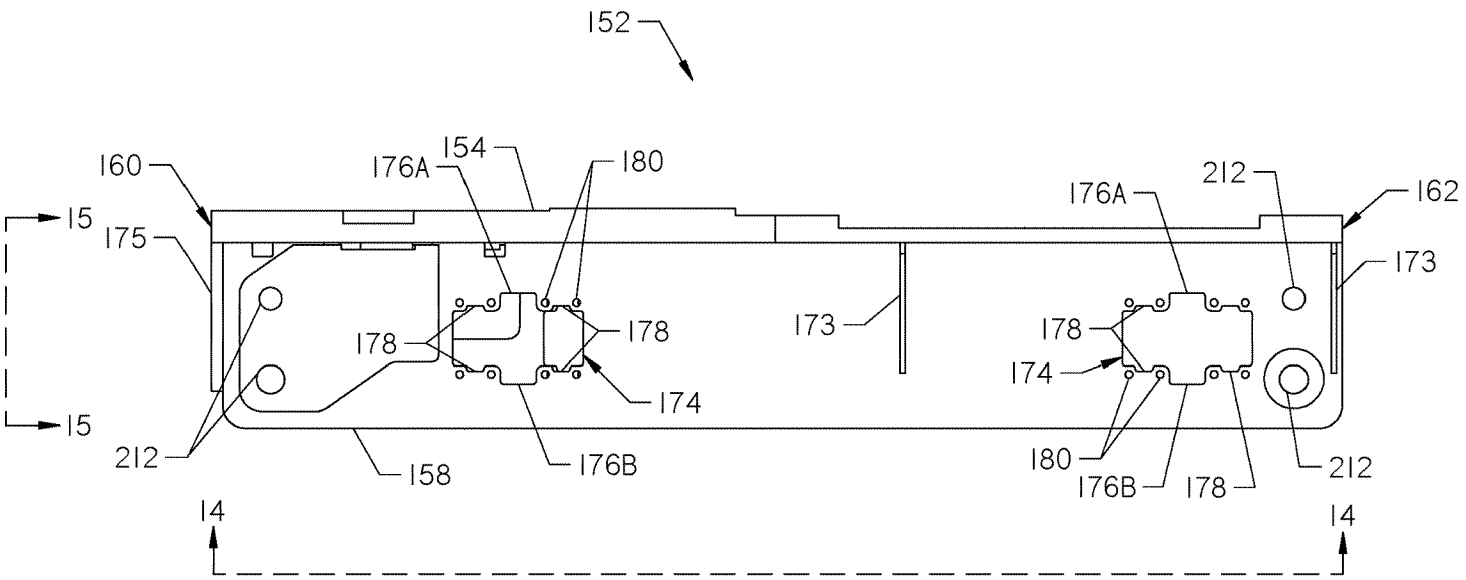
FIG. 12 is a side view of the inboard side of the carriage taken along line 12-12 of FIGS. 14 and 15.
Figure 13:
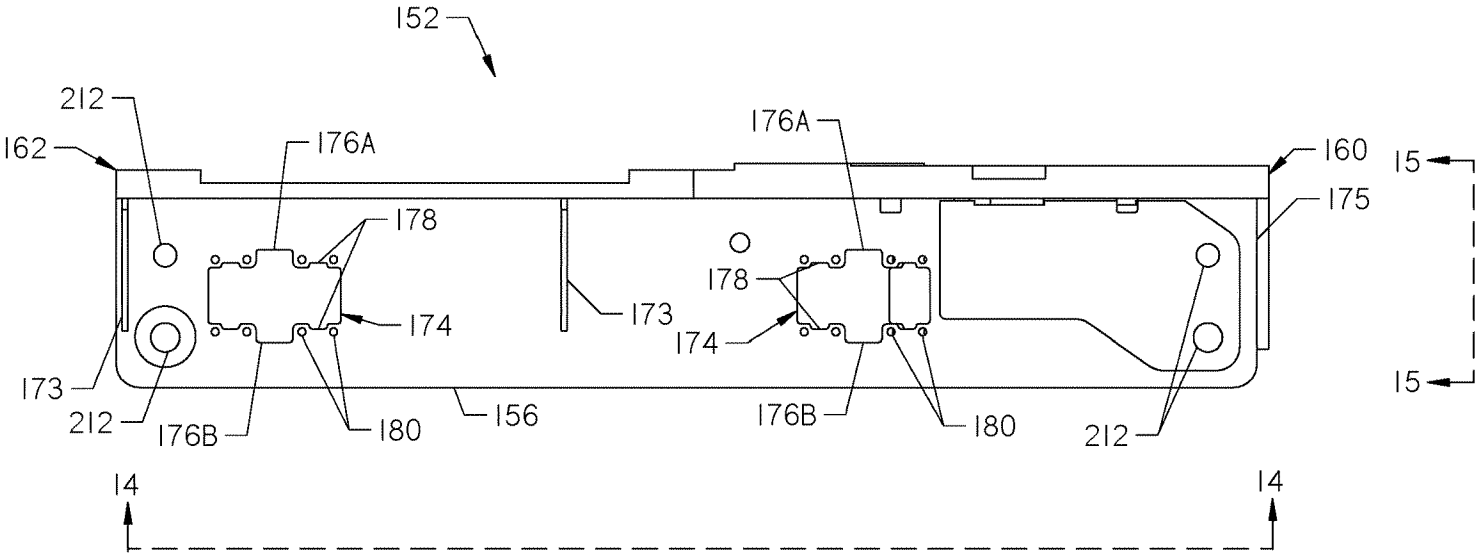
FIG. 13 is a side view of the outboard side of the carriage taken along line 13-13 of FIGS. 14 and 15.
Figure 14:
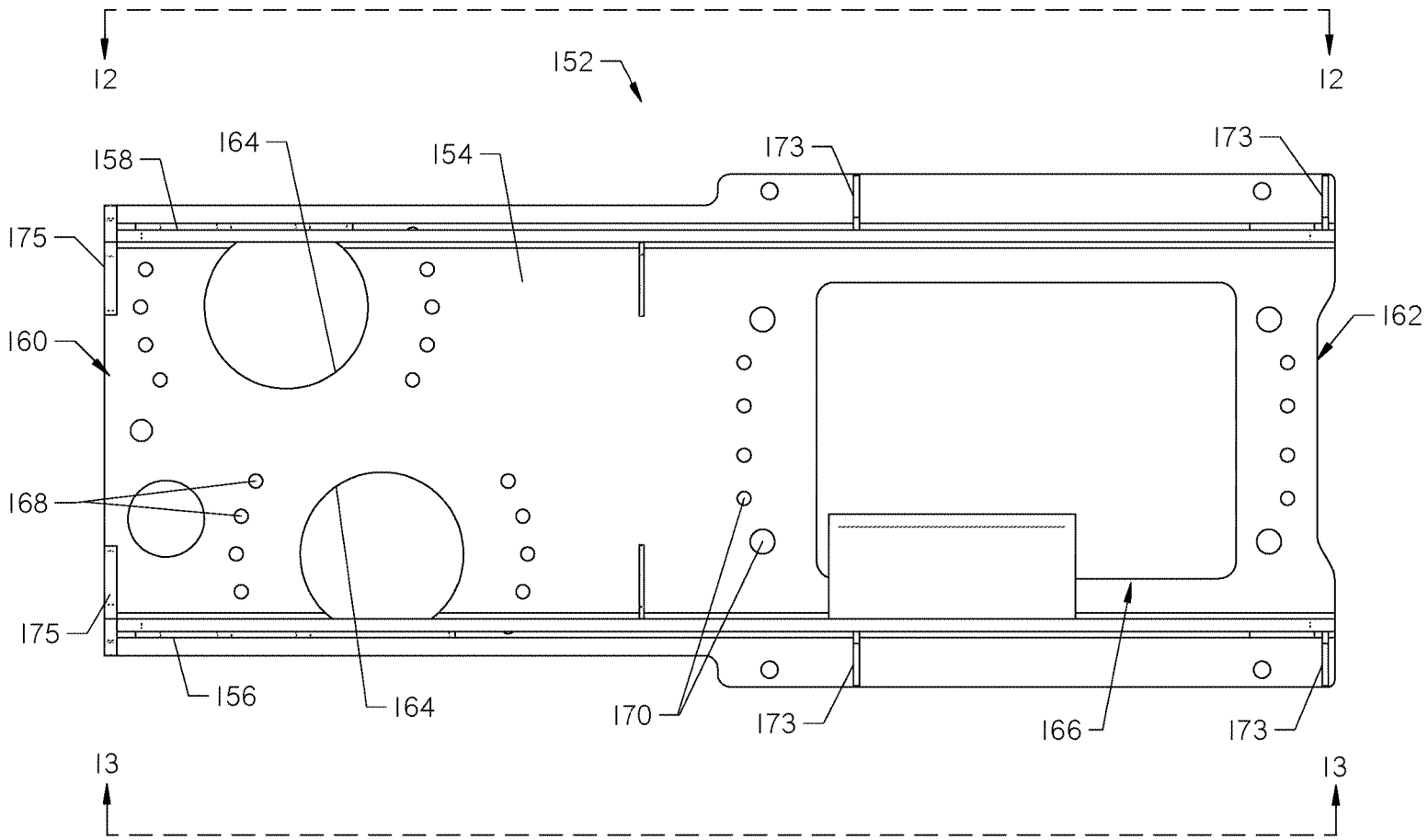
FIG. 14 is a bottom view of the carriage taken along lines 14-14 of FIGS. 12 and 13.
Figure 15:
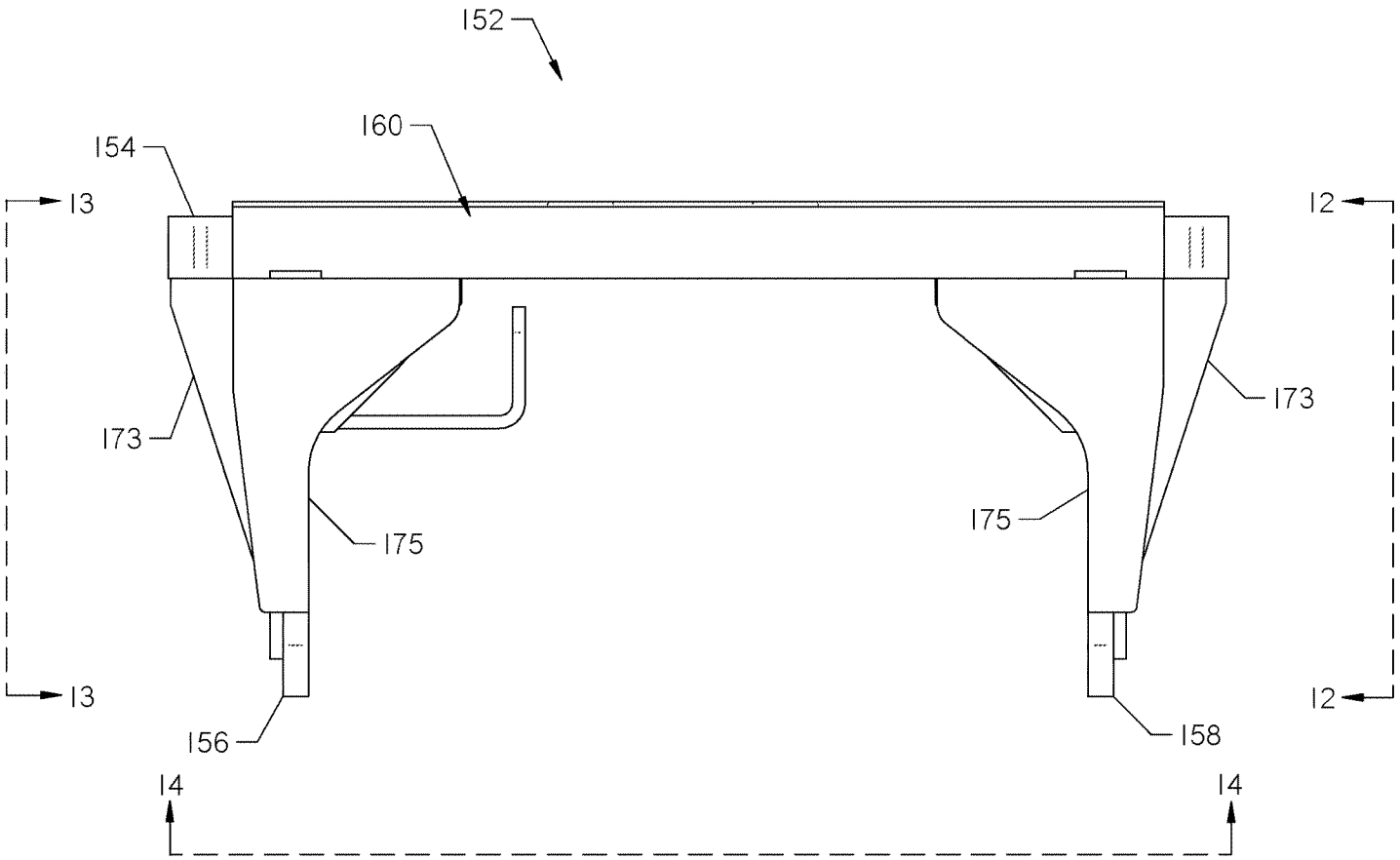
FIG. 15 is a back end view of the carriage taken along line 15-15 of FIGS. 12 and 13.
Figure 16:
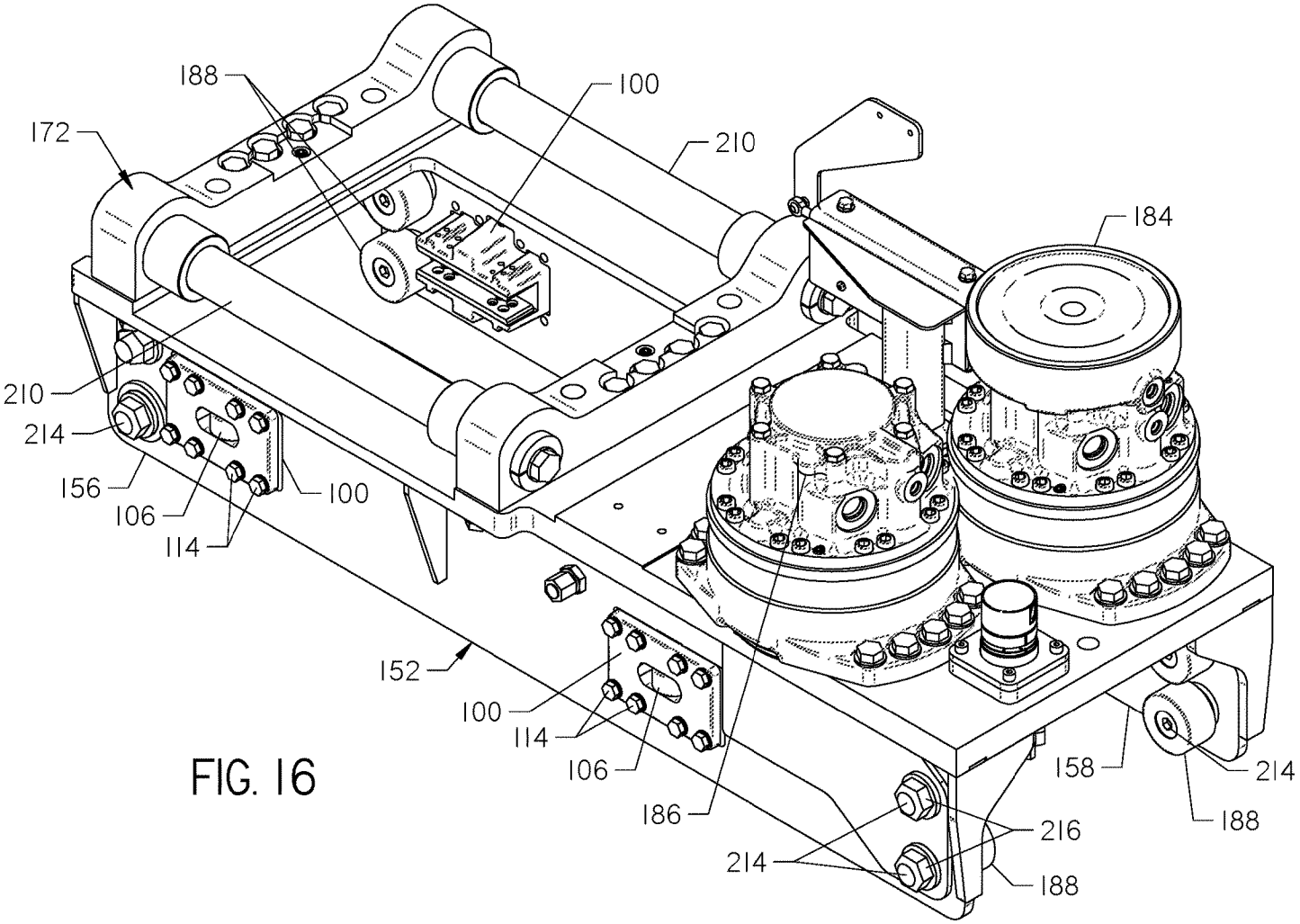
FIG. 16 is a top perspective view of the carriage shown in FIG. 9 showing the outboard side of the carriage with slide cartridges shown in FIG. 1 and thrust drives supported on the carriage.
Figure 17:
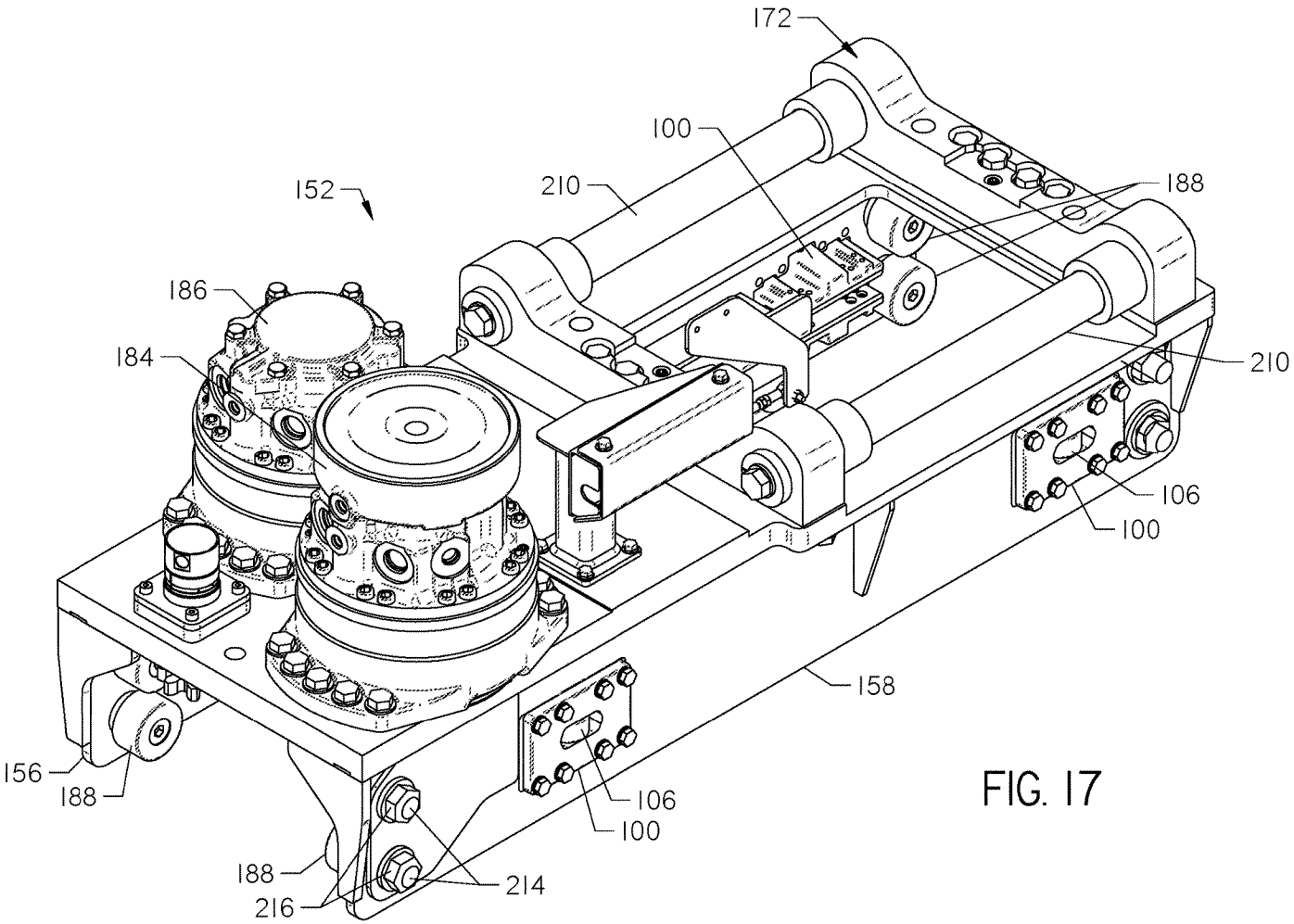
FIG. 17 is a top perspective view of the carriage of FIG. 16 showing the inboard side of the carriage.

Each wall has an outer surface 122, an inner surface 124, and plurality of holes 126. The outer surface 122 of each wall may comprise a center rib 128*a-b* that extends from the base member to the distal edge 120*a-b* of the wall, relative to the base member. The center ribs 128*a-b* provides support for the walls 104*a-b* relative to the base member 102. The center ribs 128*a-b* also engages a notch 176*a-b* formed in an opening 174 in the carriage 152 shown in FIG. 9 to secure the cartridge 100 in the carriage. The center ribs 128*a-b* may be wider at their base near base member 102 and narrower at their truncated apex at the distal edge 102*a-b* of the wall. Thus, the center ribs 128*a-b* may have a generally trapezoidal profile when viewing the top or bottom of the cartridge.

A bore 130 (FIG. 2) may be formed in the body 132 (FIGS. 1 and 4) of the cartridge 100 and with opposed openings 134 formed at each end in each center rib 128*a-b*. An axle 136 may be positioned in the bore 130 and through the center of wheel 106 to support the wheel for rotation relative to the cartridge 100. The axle 136 supports the wheel so that the axis of rotation 108 of the wheel is perpendicular to the centerline 110 of the channel 105. The axle 136 may be constructed from a roll pin that is driven into the body 132 and held in place within the bore 130 by friction fit.

The outer surface 122 of walls 104*a-b* may also have a pair of secondary ribs 140 laterally displaced on both sides of the center ribs 128*a-b*. Each secondary rib 140 provides additional structural support to wells 104*a-b* and may have two holes 126 formed therein. The holes 126 are configured to receive a fastener 142. Fasteners 142 may be threaded into holes 126 to secure upper and lower wear members 144*a-b* to the inner surface 122 of each wall 104*a-b*.

As shown in FIGS. 1, 2, 4, 5 and 8, the wear members 144*a-b* may have a generally rectangular profile. Each wear member 144*a-b* may be constructed from a ceramic, plastic or metal that is softer than the metal of the rail 198. This construction prevents the wear members 144*a-b* from damaging the rail. The wear members 144 may each have a mounting surface 146, shown in FIG. 8, which is flat and configured to be flush against the inner surface 122 of the walls 104*a-b*. The wear surface 148 of the wear members 144*a-b* may have beveled edges to reduce the leading edge from damaging the rail 198 when the wear member 144 first engages the rail. A plurality of fasteners 142 may be used to secure the wear members 144 to the inner surface 122 of each wall 104*a-b*. In one embodiment, the fasteners 142 may consist of four (4) threaded screws.

Figure 5:
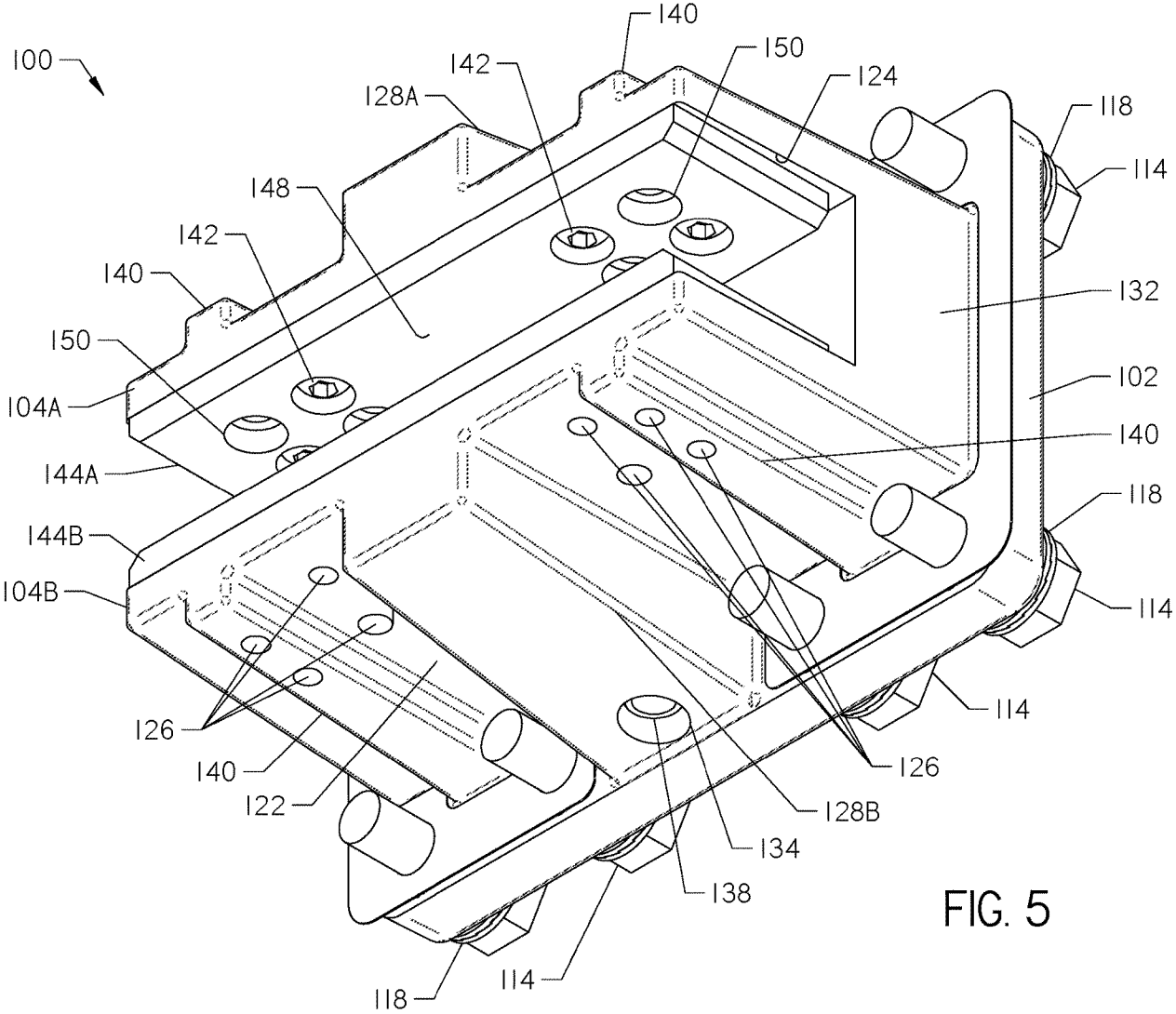
FIG. 5 is a bottom perspective view of the slide cartridge shown in FIG. 1.
Figure 6:
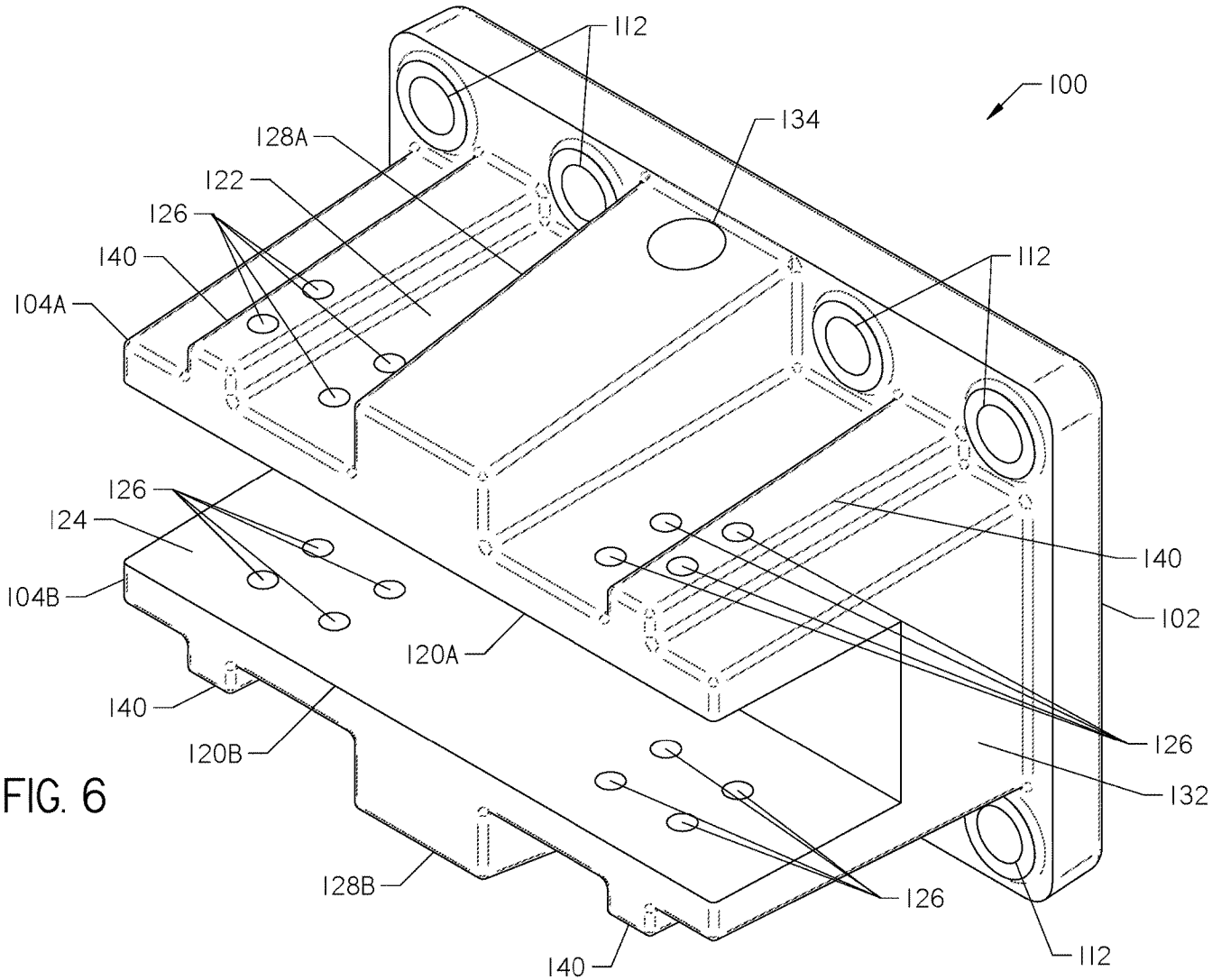
FIG. 6 is a top perspective view of the slide cartridge shown in FIG. 1, from which the wear members and fasteners have been removed.
Figure 7:
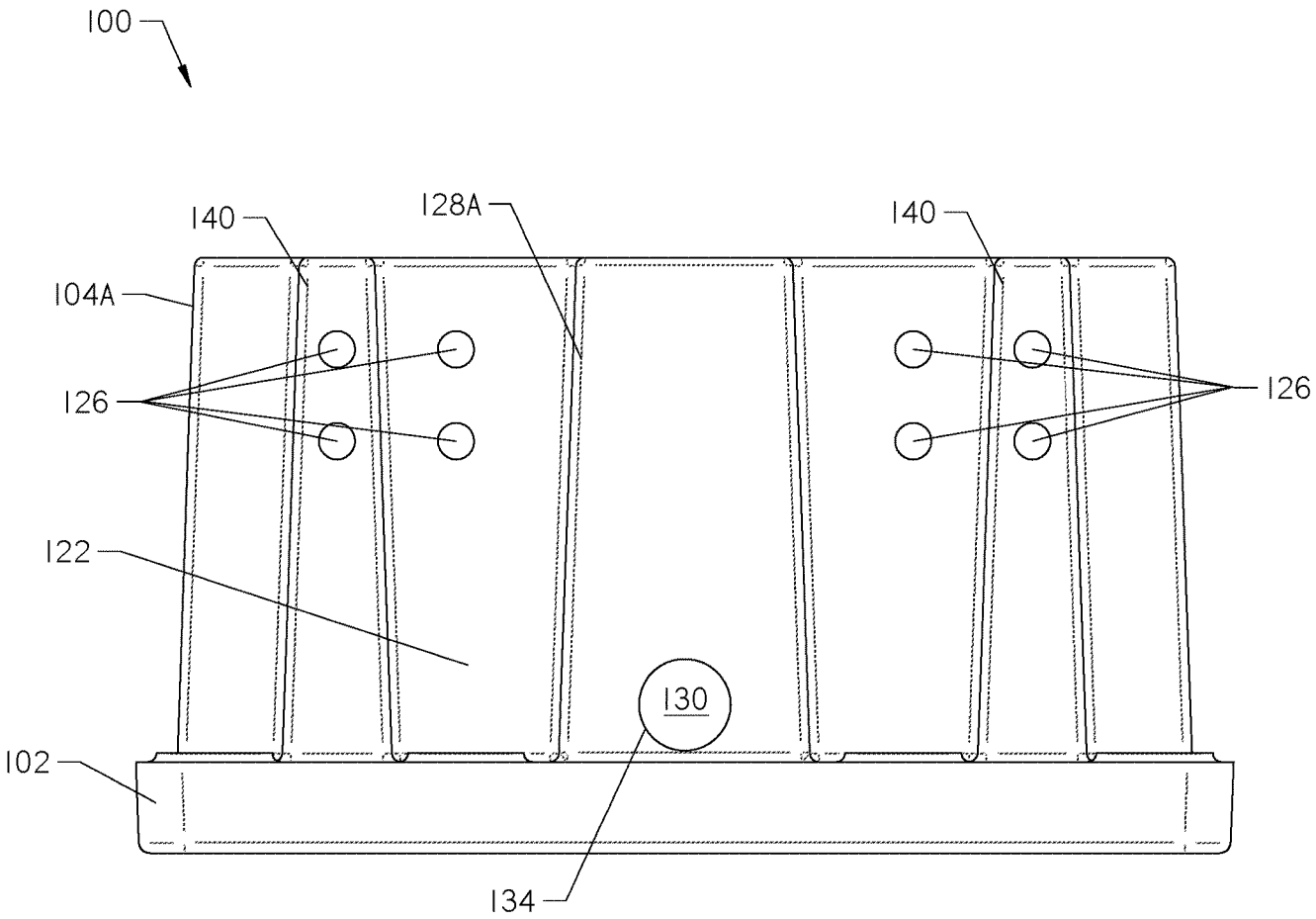
FIG. 7 is a top view of the slide cartridge shown in FIG. 6.
Figure 8:
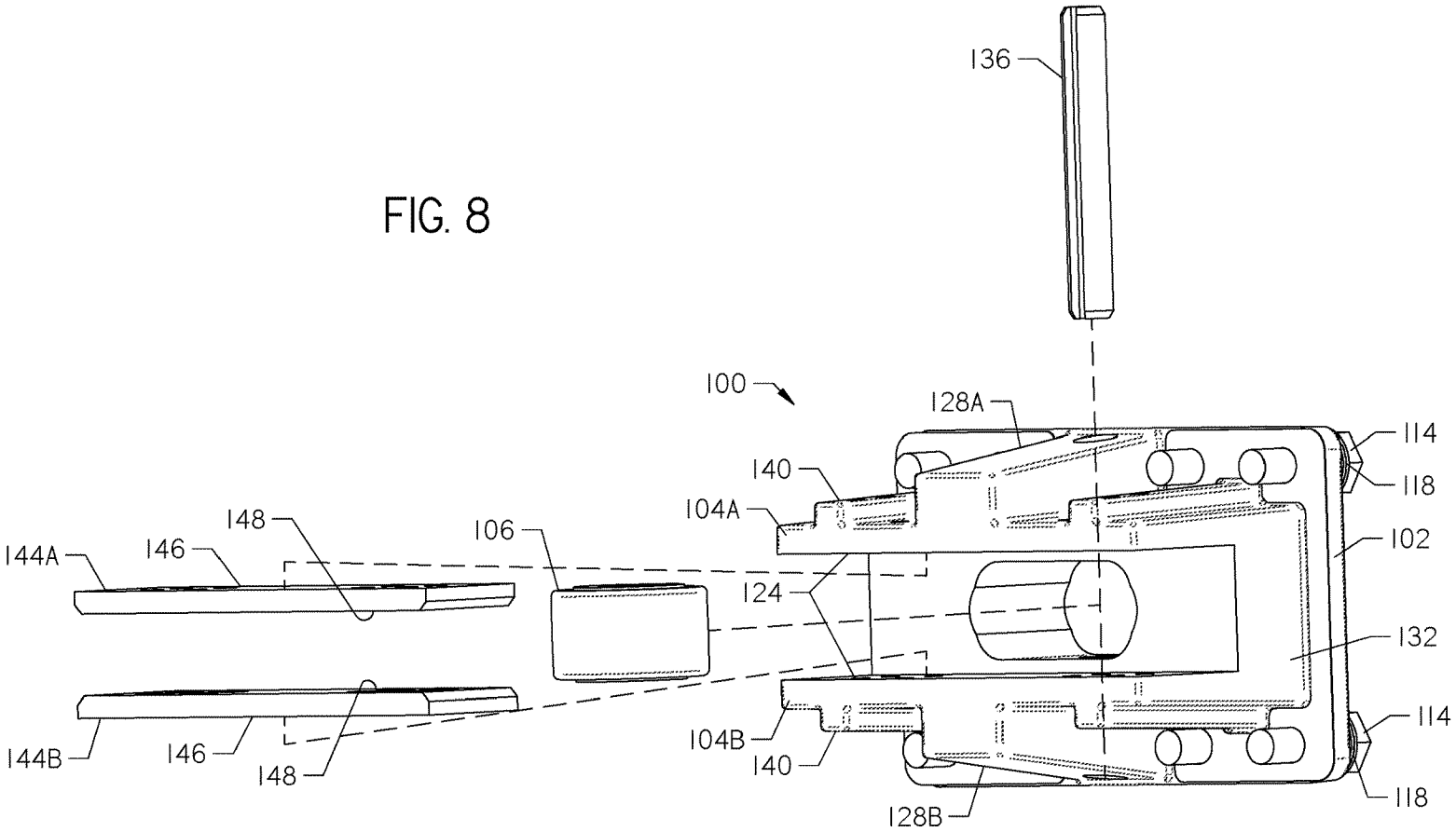
FIG. 8 is a partially exploded view of the slide cartridge shown in FIG. 1.

The use of threaded screws as fasteners 142 permits replacement of worn wear members 144 without requiring replacement of the entire cartridge 100. Holes 150 formed in the wear members 144 may have a countersunk portion sized to permit the head of fasteners 142 to be positioned below the wear surface 148 of pads 144*a-b*. Positioning the fasteners 142 as shown in FIGS. 1 and 5 is beneficial because the fasteners 142 perform the additional function of a wear indicator. When the wear surface has worn away from travelling up and down the rail of the HDD machine, the fastener may become exposed or close to exposure. The sound made by the head of a fastener 142 engaging the rail 198 will indicate to the operator that it is time to change the wear members 144.

Turning now to FIGS. 9-15, the carriage 152 will be discussed in detail. The carriage has a base 154 and first 156 and second 158 cantilevered walls attached to the base. The carriage 152 has a generally rectangular box shape, having the bottom and ends of the box removed.

The base 154 is comprised of an elongate and flat piece of steel that forms the top of the carriage 152. The base 154 has opposed first and second ends 160 and 162. The first end 160 is oriented toward the back of the drilling machine and the second end 162 is oriented toward the front. A pair of thrust drive mounting holes 164 are cut into the base 154 near the first end 160 and a spindle clearance hole 166 is cut into the base at the second end 162 to permit the spindle 206, shown in FIG. 24, to sit lower in the carriage 152. A plurality of thrust drive fastener holes 168 are positioned around the thrust drive mounting holes 164 in an arc and will be discussed in more detail with reference to FIGS. 16-23. The base 154 also has a plurality of fastener holes 170 disposed around the spindle clearance hole 166, Fastener holes 170 are positioned on the base 154 for attachment of a spindle rail system 172, shown in FIG. 16, to the carriage.

Both walls 156 and 158 may be welded to the base 154 and further supported using a plurality of brackets 173 disposed along the interface between the walls and the base and spaced along the carriage from the first end 160 to the second end 162. End brackets 175 may be positioned at the first end of base 154 to provide additional structural support. Brackets 173 and 175 may be welded to the walls and the base 154 so the walls are perpendicular to the base and parallel to each other.

Each wall 156 and 158 has two slide cartridge mounting holes 174, Each cartridge mounting hole 174 is sized to closely conforms to the profile of the cartridge 100 described herein with reference to FIGS. 1-8. Each mounting hole 174 has top and bottom center notches 176*a-b*. Each center notch 176*a-b* has an internal profile that closely conforms to the profile of the center ribs 128*a-b* of the cartridge 100. Additionally, each mounting hole 174 has top and bottom laterally displaced notches 178. Notches 178 have a profile that closely conforms to the profile of the secondary ribs 140, shown in FIG. 1.

Figure 18:
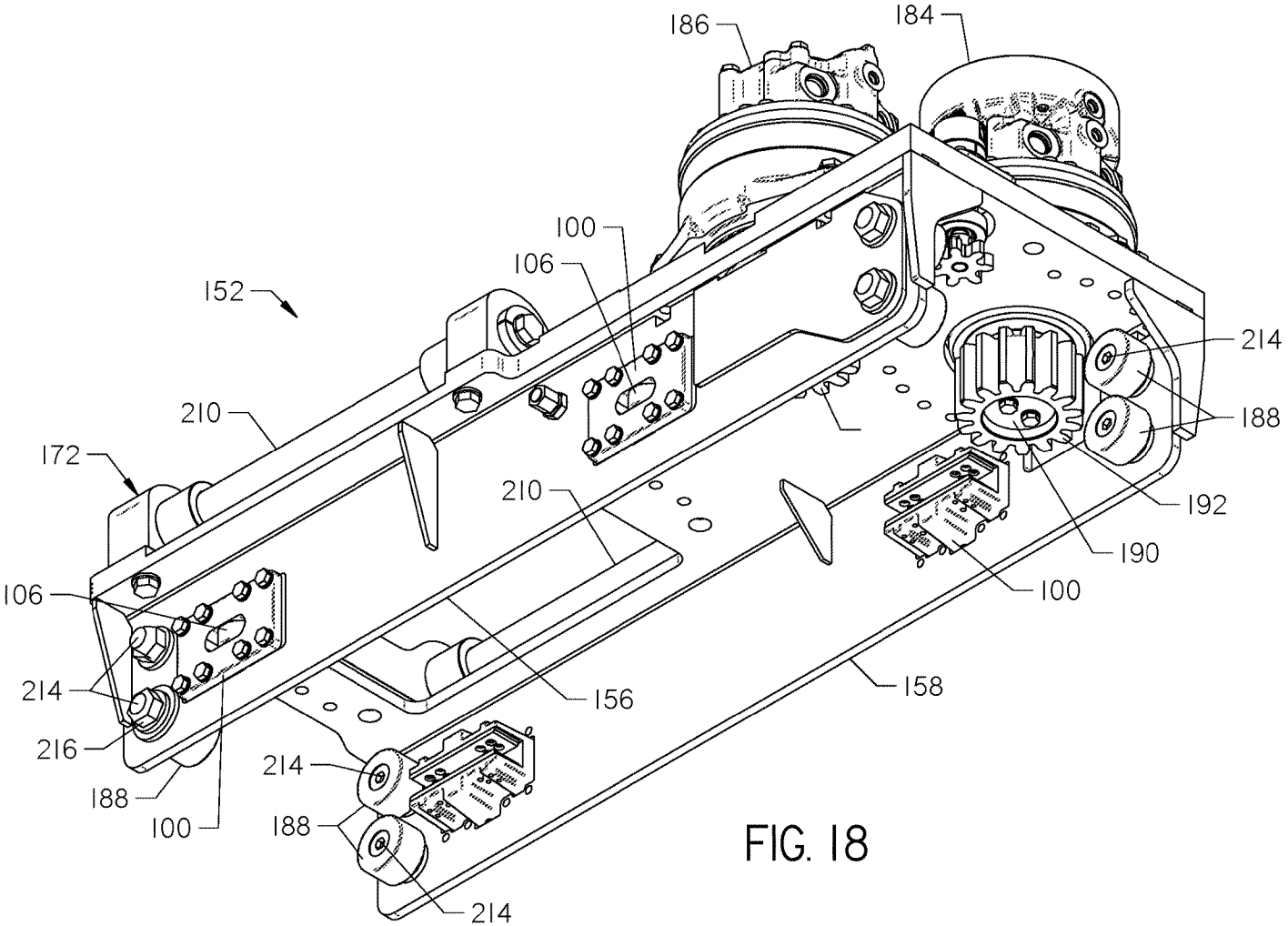
FIG. 18 is a bottom perspective view of the carriage shown in FIG. 16, showing the outboard side of the carriage.

Referring now also to FIGS. 16-23, a cartridge 100 is installed on the carriage 152 by inserting the cartridge into the mounting hole 174 such that the channel is disposed between the first 156 and second 158 walls, as shown in FIG. 18. The cartridge 100 is inserted into the mounting hole 174 until the base member 102 of the cartridge abuts wall 156 or 158. The cartridge 100 should be positioned so that holes 112 align with corresponding holes 180 formed in the walls.

Once aligned, fasteners 114 may be threaded into holes 112 and 180 to secure the cartridge to the carriage 152. A shim 182 (FIG. 1) may be positioned between the base member 102 and wall 156 or 158 of the carriage 152 to properly position the channel 105 within the carriage. The shim 182 is also used to space the wheel 106 from the edge of the wheel. The thickness of the shim 182 permits the distance between the wheel 106 and the edge of the rail 198 to be adjusted as desired. The shim 182 may be constructed from steel.

Figure 26:
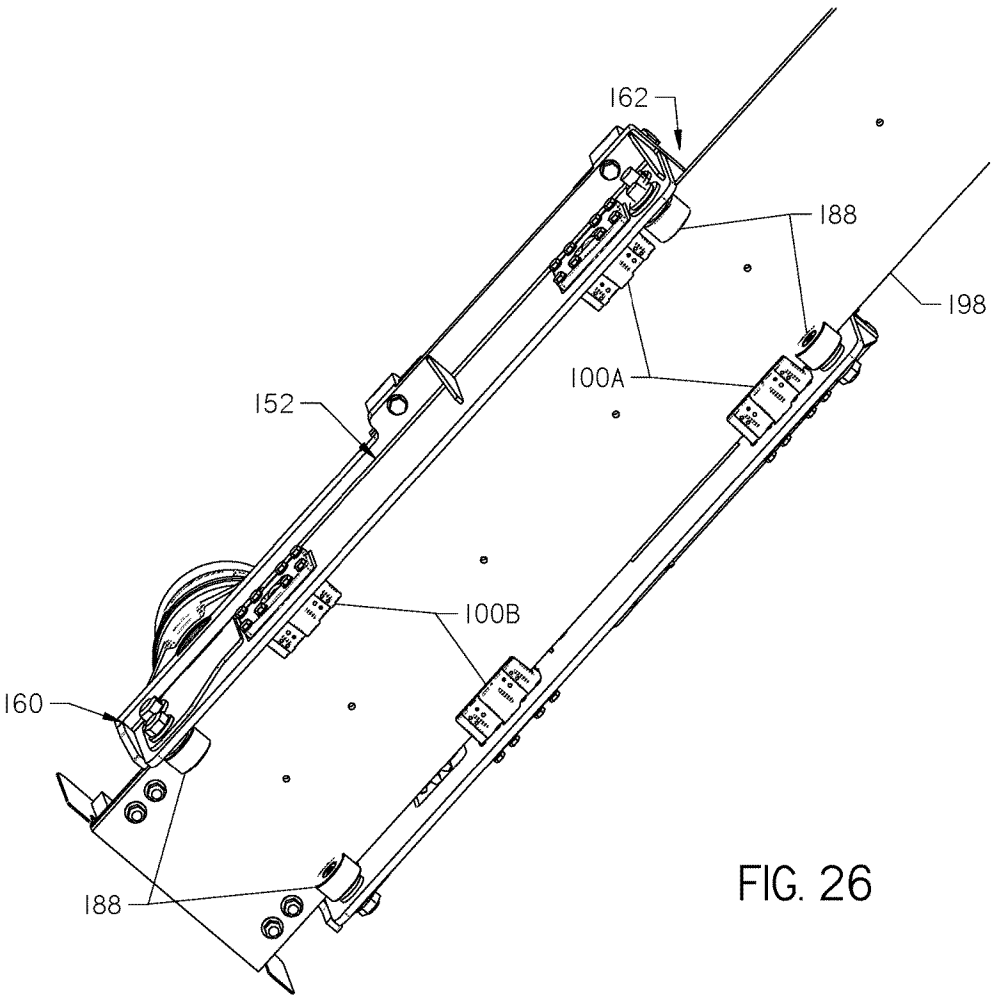
FIG. 26 is a bottom perspective view of the carriage supported on the rail of a horizontal directional drilling machine showing the slide cartridges partially covering the rail.

Preferably the carriage 152 may be constructed to have four (4) mounting holes 174 for cartridges, with two in each wall. As shown in FIG. 26, is not necessary for the cartridges supported in wall 156 to be horizontally aligned with the cartridges supported in wall 158. However, the cartridges should be aligned vertically on the walls 156 and 158 to reduce the likelihood of binding as the carriage moves along rail.

Turning now to FIGS. 16-23, the carriage 152 is shown having the thrust drives 184 and 186, spindle rail system 172, the cartridges 100, and a plurality of rollers 188 mounted to the carriage.

Figure 19:
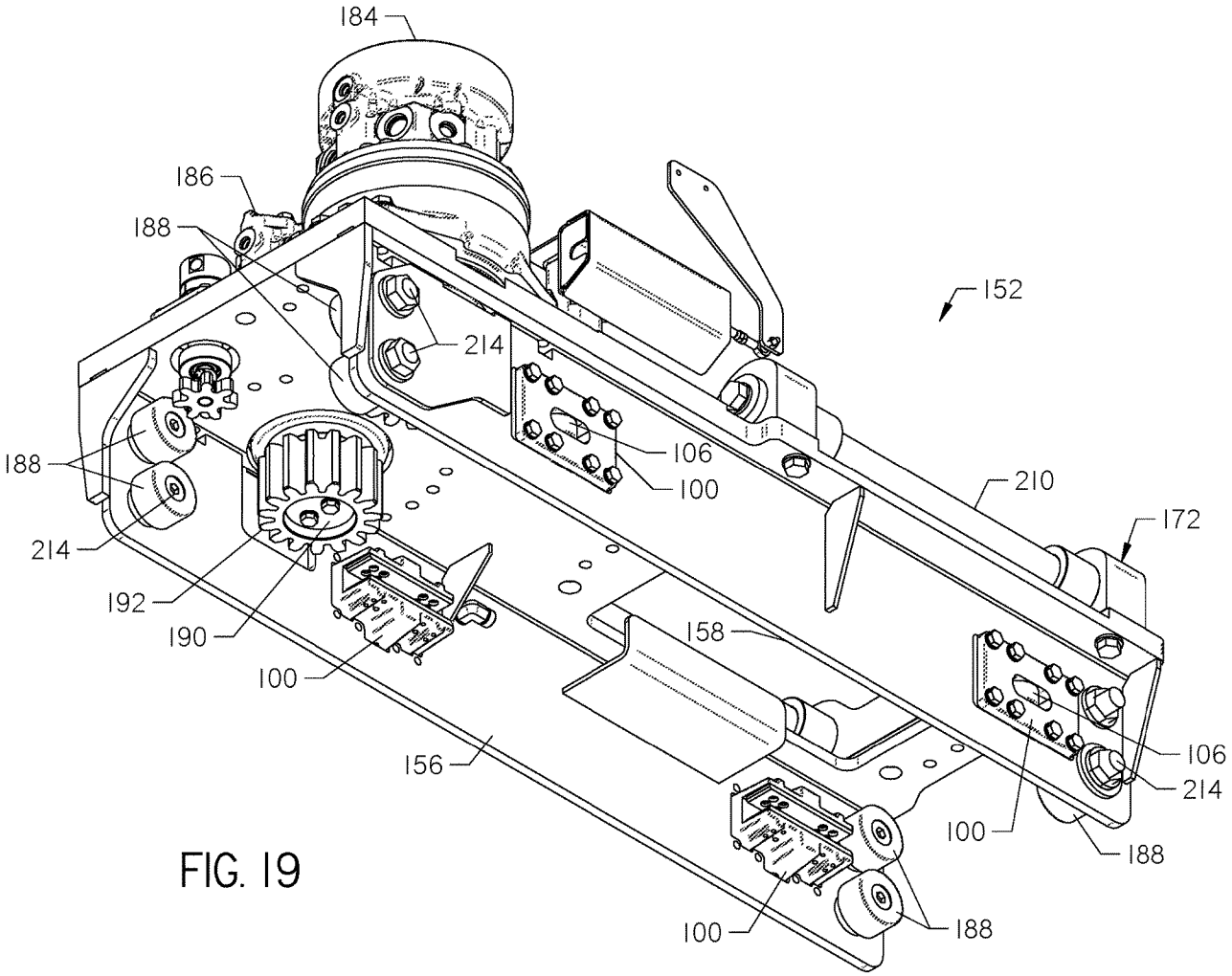
FIG. 19 is a bottom perspective view of the carriage shown in FIG. 18, showing the inboard side of the carriage.
Figure 20:
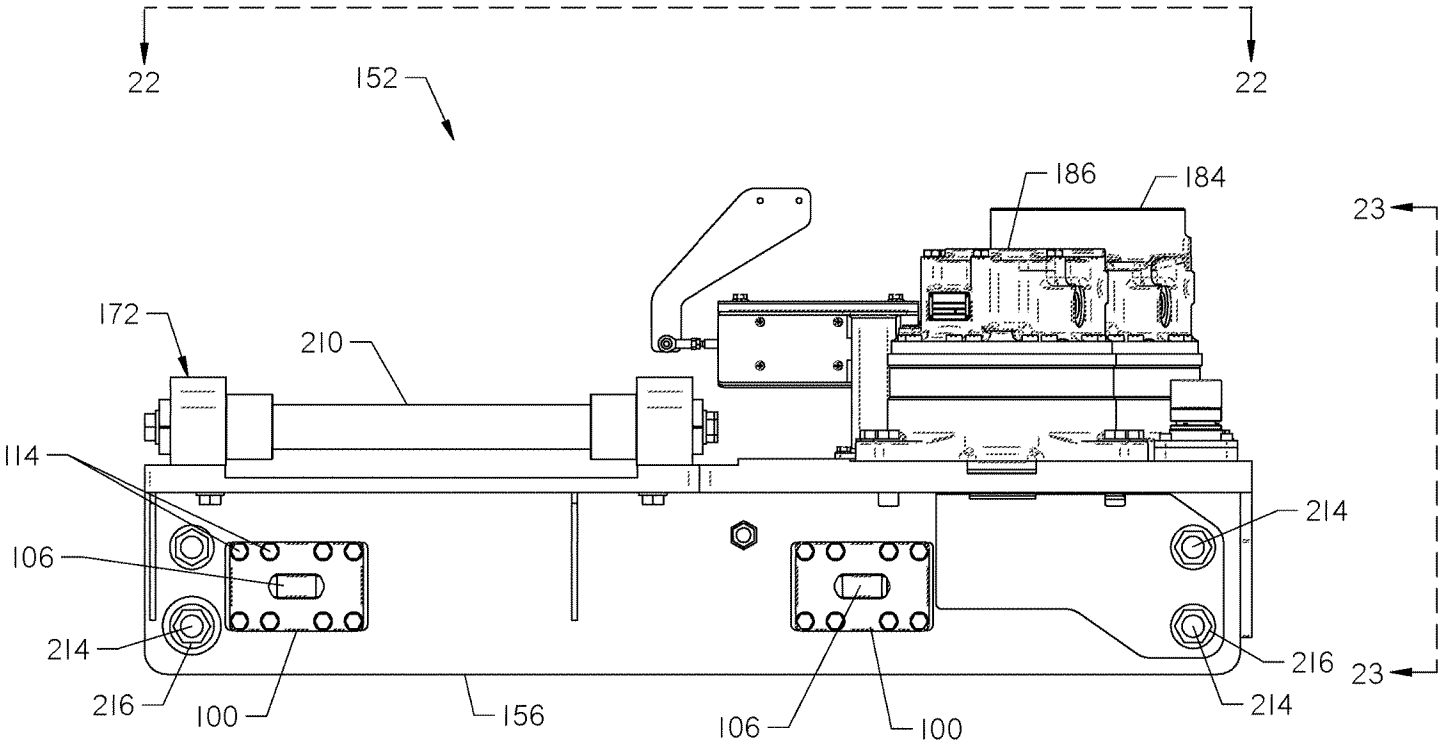
FIG. 20 is a side elevation view of the outboard side of the carriage shown in FIG. 16 taken along line 20-20 of FIGS. 22 and 23.
Figure 21:
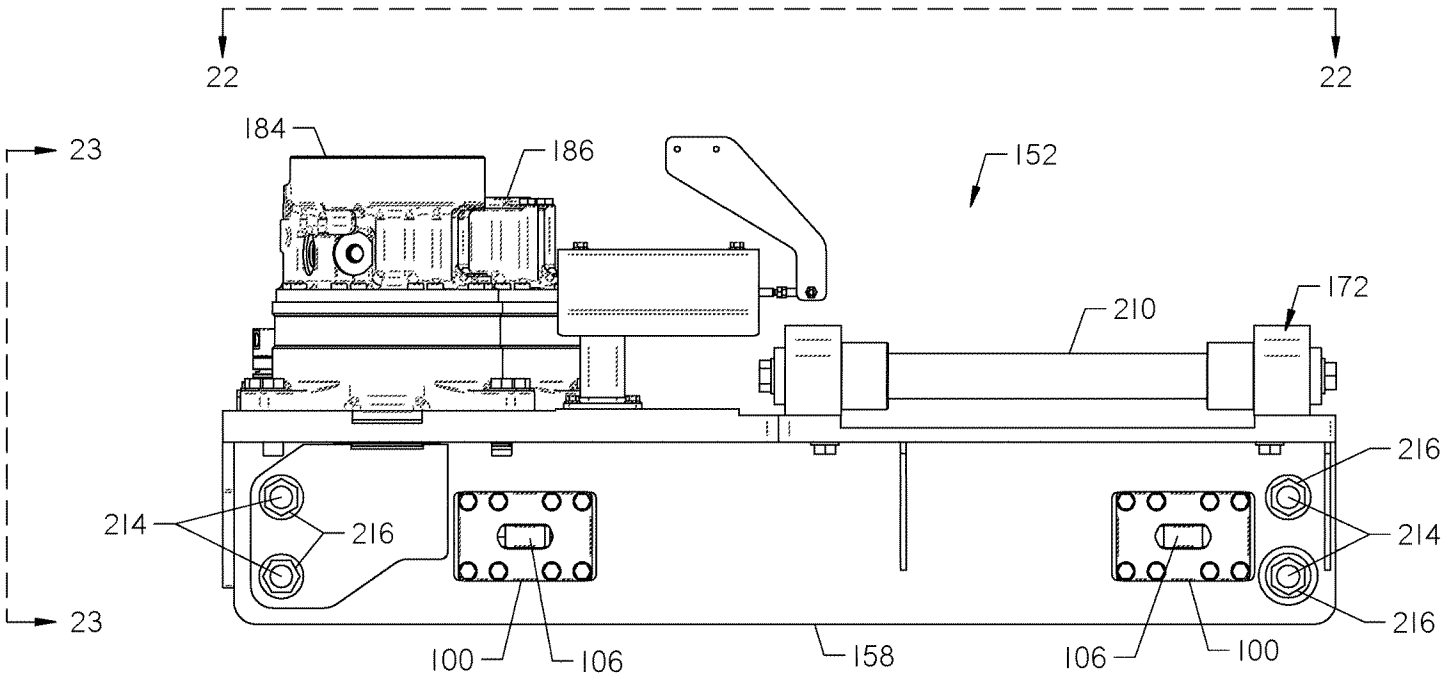
FIG. 21 is a side elevation view of the inboard side of the carriage opposite the outboard side shown in FIG. 20, taken along line 21-21 of FIGS. 22 and 23.
Figure 22:
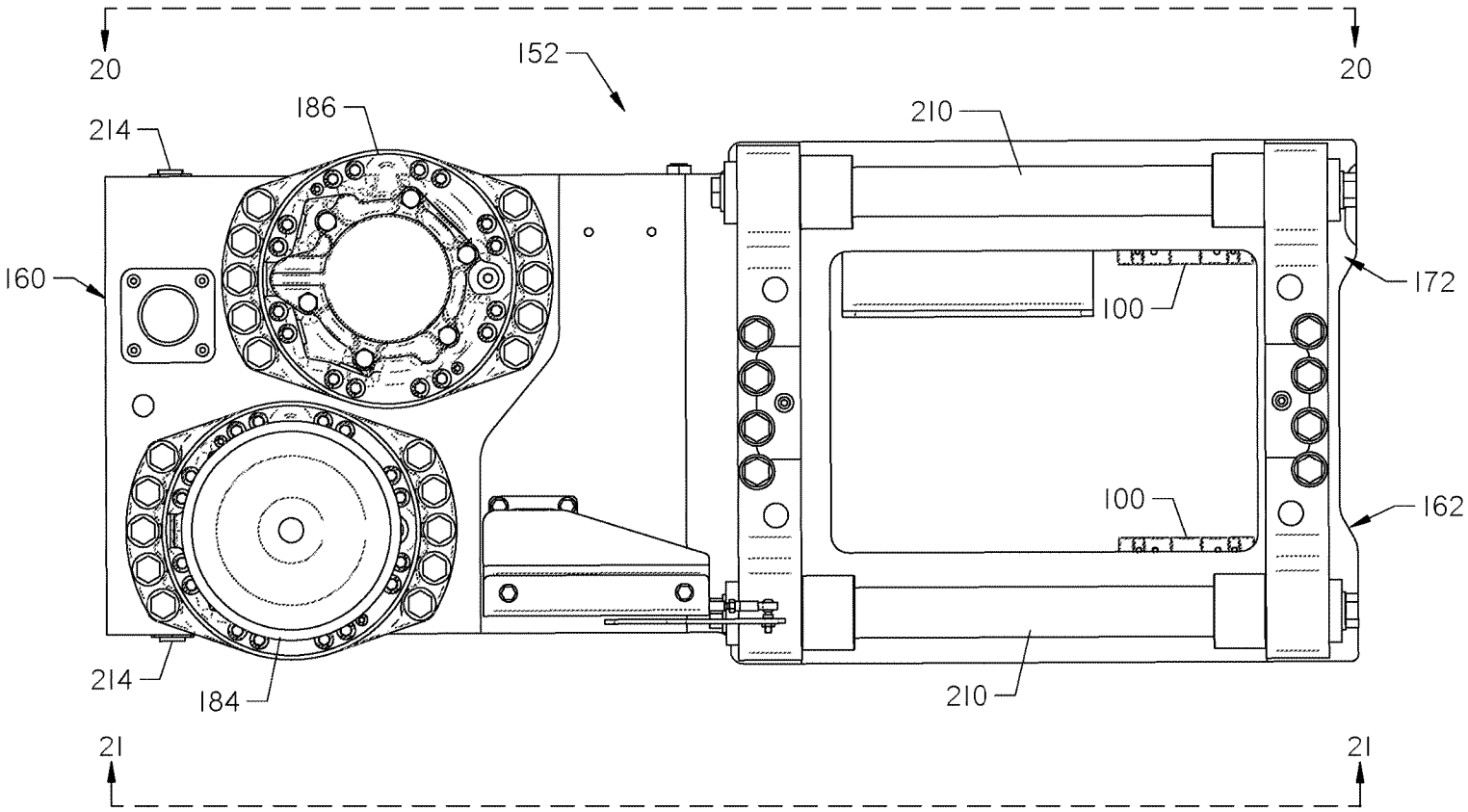
FIG. 22 is a top view of the carriage taken along line 22-22 of FIGS. 20 and 21.
Figure 23:
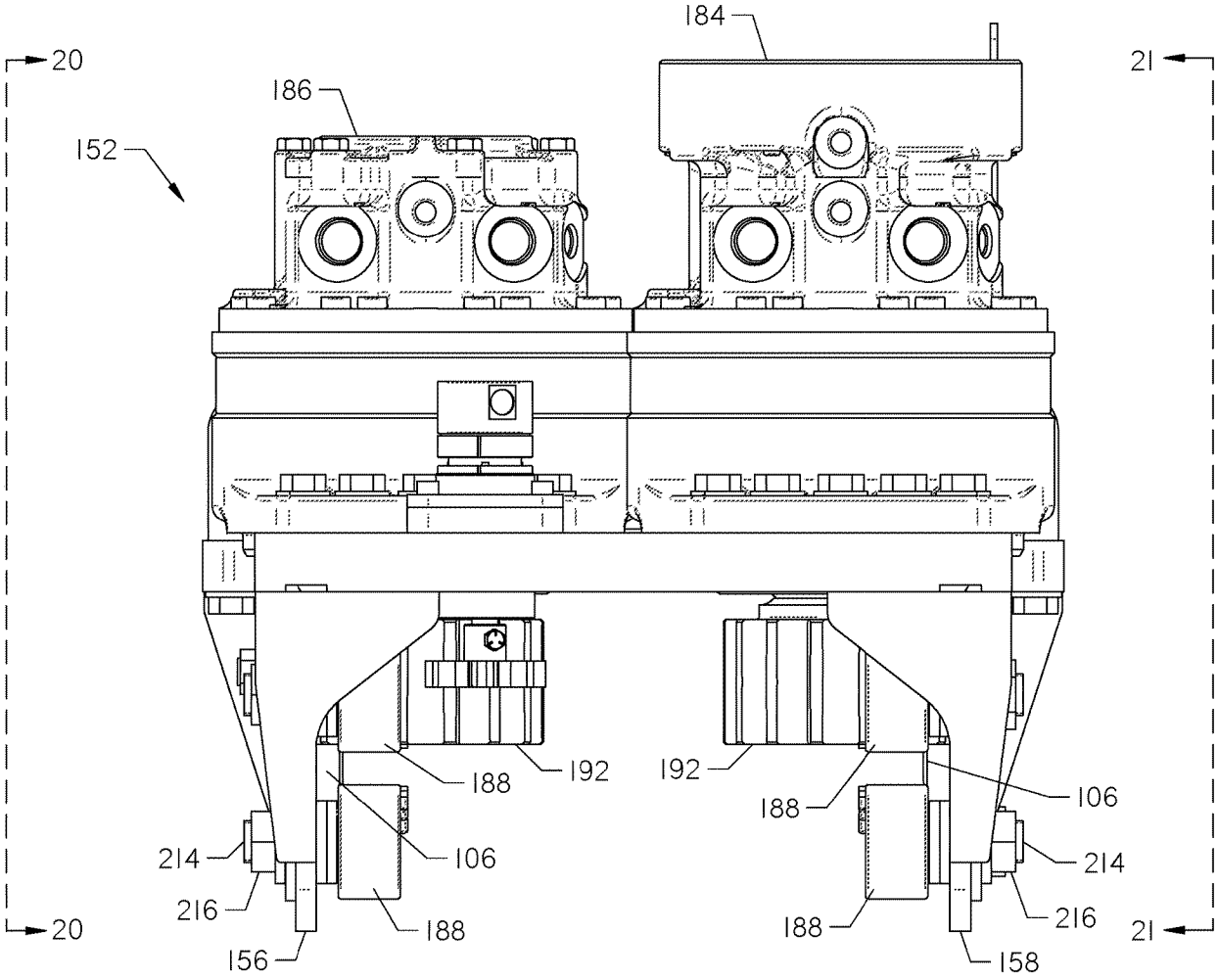
FIG. 23 is a back-end elevation view of the carriage taken along line 23-23 of FIGS. 20 and 21.

The thrust drives 184 and 186 may comprise hydrostatic motors. As shown in FIGS. 18 and 19, each thrust drive has a drive shaft 190 that supports a drive pinion 192. The drives 184 and 186 are supported on the carriage 152 so that the drive pinions 192 are disposed inside the carriage and positioned above a gap formed between a pair of rollers 188 (FIG. 23). The pinions 192 are positioned to engage a toothed rack 194, shown in FIG. 24, supported on the drilling machine frame 196, shown in FIG. 24.

The thrust drives 184 and 186 turn the pinions 192 to drive the carriage 152 along the rack 194 between the front and back of the machine frame 196. Supported below the rack 194 is an elongate rail 198 having opposed first and second ends. The first end 200 is disposed proximate the back end of the drill rig 10. The second end 204 is disposed proximate the front end of the machine 10 near the operator station 205. The rack 194 may be fastened to the top of the rail using a plurality of bolts.

The width of the rail 198 should allow it to fit between the walls 156 and 158 of the carriage 152, and preferably to engage wheels 106 disposed in cartridges supported on both wall 156 and 158, to limit lateral movement of the carriage.

Figure 25:
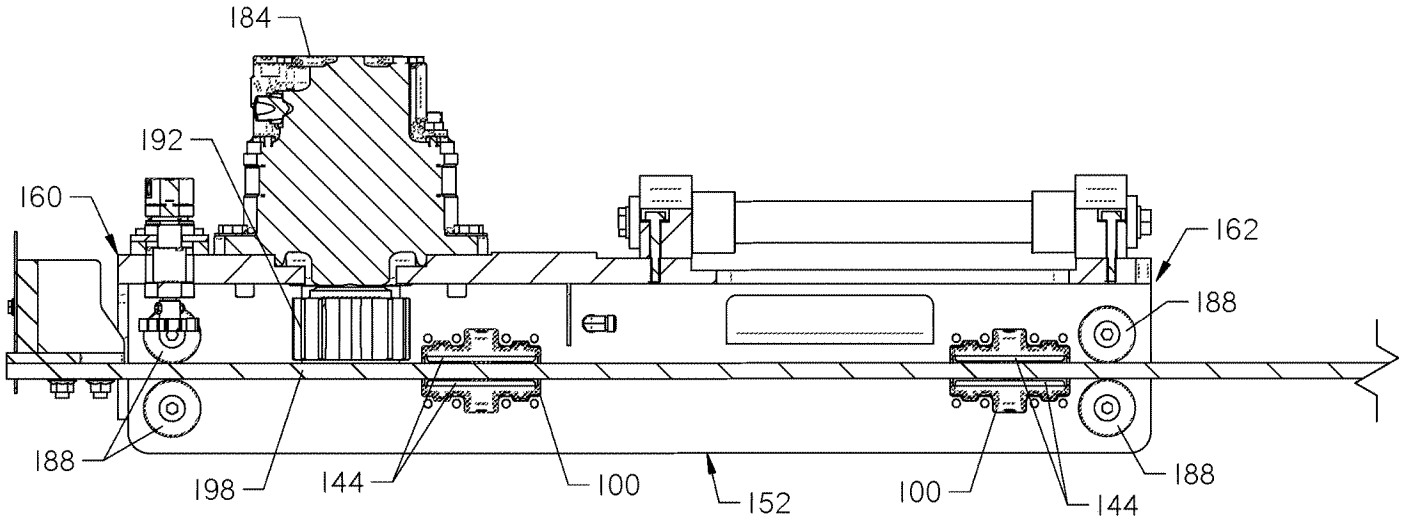
FIG. 25 is a partially sectional view of the carriage shown in FIGS. 16-23 and a rail showing the slide cartridge shown in FIG. 1 supported on the carriage and the carriage positioned on the rail. For clarity the rack, drill frame, and operator cab have been omitted.

As shown in FIG. 25, the rail 198 is situated so that it is positioned between each pair of rollers 188 and within the channel of each cartridge 100. In this configuration, the rollers 188 engage the rail and roll along the rail 198 as the carriage 152 moves between the first and second ends of the rail and there is a gap between the rail and the wear members 144.

The cartridges 100 may provide a secondary way of supporting the carriage 152 for movement along the rail 198 in the event one or more of the rollers 188 malfunction or break. Using the cartridges 100 as a back-up way of supporting the carriage on the rail allows the operator to continue drilling until a replacement roller 188 can be installed. Alternatively, the rollers 188 may be eliminated from the carriage and the cartridges may be used as the primary support of the carriage on the rail.

Continuing with FIGS. 16-23, the spindle rail system 172 supports a spindle 206 and spindle drive 208. The spindle 206 and spindle drive 208 are supported on shafts 210 shown in FIG. 16. The spindle 206 and spindle drive 208 are moveable along the shafts 210 of the spindle rail system 172 relative to the carriage 152. This small range of movement along the shafts 210 may be advantageous during make-up and break-out of pipe sections with the drill string 16, shown in FIG. 28, if the pipe sections become misaligned or cross-threaded.

Rotation of the spindle 206 is driven by the spindle drive 208. The spindle 206 is connected to the first end of an elongate drill string 16 shown in FIG. 28. The drill string 16, shown in FIG. 28, may have a plurality of pipe sections joined end-to-end. As shown in FIG. 28, a downhole tool 24 comprising a drill bit 18 or backreamer (not shown) may be operatively connected to the second end of the drill string. The spindle 206 and spindle drive 208 drive rotation of the drill string 16 and the downhole tool 24. The thrust drives 184 and 186 drive thrust and pullback of the downhole tool 24.

The rollers 188 may be fastened to the carriage walls 156 and 158. As shown in FIGS. 9-13 four rollers may be supported on each wall 156 and 158. Each roller 188 may have an axle 214 that extends through a mounting hole 212. The free end of each axle 214 may have external threads. Bolts 216 may be threaded onto the axles 214 to fasten the rollers 188 to the carriage walls 156 and 158. As shown in FIG. 25, the rollers 188 may be positioned in pairs so that one roller of the pair is positioned above the rail 198 and one positioned below the rail.

Figure 28:
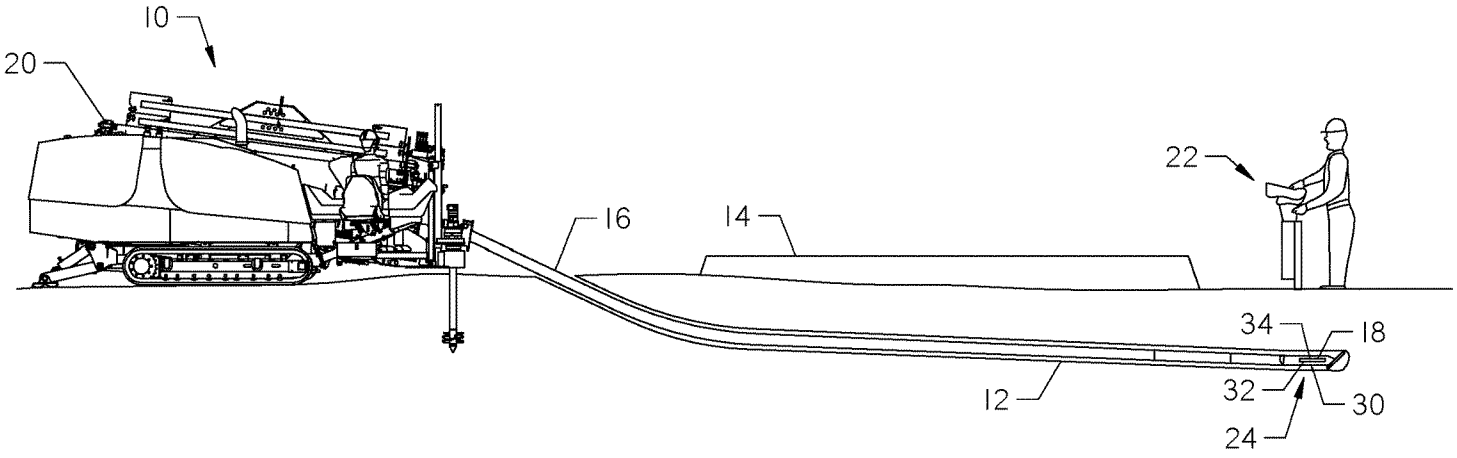
FIG. 28 is an elevation view of a horizontal directional drilling operation drilling a borehole under a roadway.

As shown in FIG. 28, the HDD machine 10 "makes up" sections of pipe to form is the drill string 16, then advances the drill string forward through rotation and thrust provided to a downhole tool 24, The process is repeated until a borehole 13 of a desired length and width is created. The HDD machine 10 may also be used with a "backreamer," wherein a drill string 16 is pulled back and rotated through a pilot bore to enlarge the pilot bore. In this method, sections of pipe are removed from the drill string 16 as the backreamer is pulled through the bore.

The HDD machine 10 comprises a vise assembly 218, the frame 196, and the carriage 152. The spindle system 172 attached to the carriage 152 supports the spindle 206 and spindle drive 208. The spindle 206 is adapted to attach to a pipe segment for connection or disconnection from a drill string 16 (FIG. 28). The vise assembly 218 provides high-torque make-up and breakout rotation for the pipe segment, while low-torque (but higher speed) rotation is provided by the spindle drive 208.

The carriage 152 supports the spindle 206 as well as the drive 208 for rotating the spindle. The carriage 152 is adapted to move along the frame 196 to provide thrust or pullback to the drill string 16 during drilling or backreaming operations, and to move a pipe segment during pipe handling operations. The frame 196 supports the rack 194 and the rail 198. As shown, the rack 194 is grooved to provide a two-way reaction for a powered pinion drive on the carriage 152. The rail 198 provides support for the weight of the carriage 152 as it travels along the frame 196.

With reference now to FIG. 25, the carriage 152 as supported on the rail 198 is shown in further detail. The carriage 152 comprises a drive pinion 192, a plurality of support rollers 188 disposed near each end of the carriage 152, and a plurality of slide cartridges 100. The drive pinions 192 interact with the rack 194, shown in FIG. 24, to move the carriage 152 along the rail 198.

The paired sets of rollers 188 engage the rail 198 to provide support and movement for the carriage 152 along the rail between the first and second ends of the machine 10. As shown, the rollers 188 are not powered, but are bolted to the carriage 152 and freely rotate. Alternatively, each of the groups of paired rollers 188 could he replaced with a single is "top" roller. Paired top and bottom rollers are preferred, with the bottom roller and each pair providing stability for the carriage 152 as it travels along the length of the rail 198. Alternatively, each of the groups of paired rollers 188 could be replaced with a single "top" roller.

Figure 27:
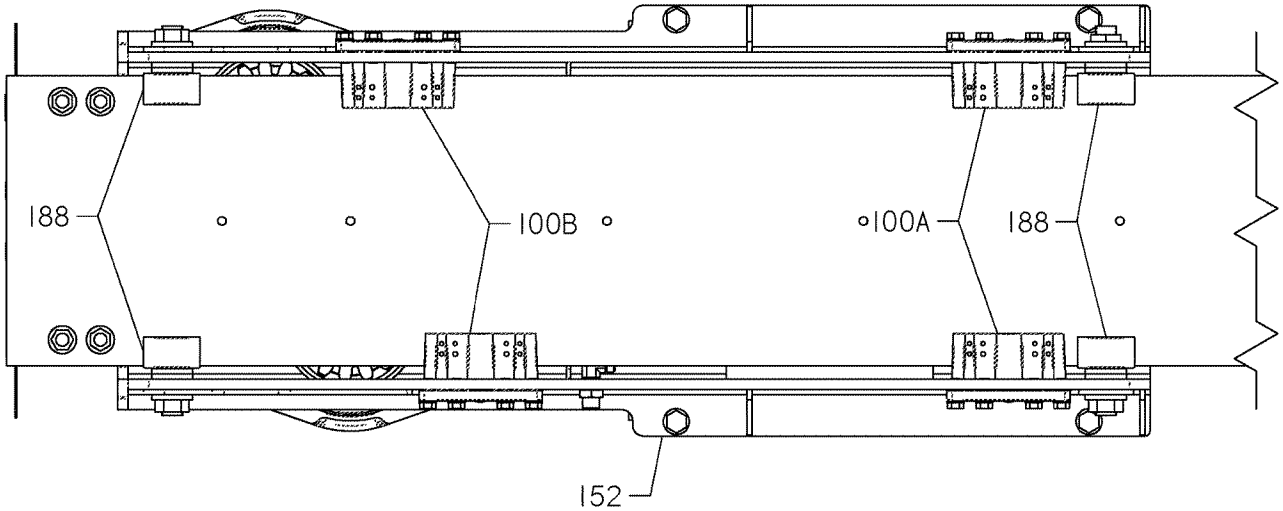
FIG. 27 is a bottom view of the carriage and rail shown in FIG. 26.

The slide cartridges 100, as shown, are bolted to the carriage 152. As shown in FIGS. 26 and 27 the front slide cartridges 100*a* are supported on the carriage proximate a set of paired rollers. However, the back slide cartridges 100*b* are spaced apart from the rollers 188 supported at the first end 160 of the carriage. This spacing provides additional stability and provides room for the drive pinions 192 between the rail and carriage.

During operation of the HDD machine 10, the rail 198 may not touch either of the wear members 144 when the rollers 188 are engaged and rolling along the rail. The distance between the wear members 144 and the rail 198 is preferably less than half an inch.

Four sets of paired rollers 188 provide supportive mobility for the carriage 152 as it is moved along the rail 152. However, it is possible for the top roller 188 of a set of paired rollers to break during operation. In the absence of the slide cartridge 100, the results of such a break are instability of the carriage, possible total breakdown of drilling operations, and damage to other component parts, such as the rail, drive pinion, and other sets of paired rollers. The slide cartridges 100 provide a "back-up" to the paired rollers. When the top roller of a particular set of paired rollers breaks, the weight of the carriage 152 causes that corner of the carriage 152 to fall. The cartridge 100 will catch the carriage on the wear member 144 and permit drilling to continue.

As shown in FIG. 25, the slide cartridge 100 closest to a set of paired rollers 188 is positioned such that a fall of this sort need be very slight before the wear pad 144 on the upper wall of that slide cartridge contacts the rail 198. The carriage 152 can continue drilling operations with one or more slide cartridges 100 contacting the rail 198. Frictional forces between the slide cartridge 100 and the rail 198, while higher than corresponding forces produced by the wheel, are not so high as to restrain continued movement of the carriage 152. Any broken rollers may be replaced at a convenient time.

Referring now to FIG. 28, there is shown an overall HDD system for use with the present invention. FIG. 28 illustrates the usefulness of HDD by demonstrating that a borehole 13 can be made without disturbing an above-ground structure, namely a roadway or walkway as denoted by reference numeral 14. To cut or drill the borehole 13, the drill string 16 carrying a drill bit 18 is rotationally driven by the rotary drive system 20. The rotary drive system comprises the spindle 206 and spindle drive 208 shown in FIG. 24.

When the HDD machine 10 is used for drilling a borehole 13, monitoring the position of the drill bit 18 is important for accurate placement of the borehole and subsequently installed utilities. Therefore, the downhole tool assembly 24 make be tracked using an above ground tracking system 22 during the HDD operation.

The HDD system is useful for near-horizontal subsurface placement of utility services under above-ground obstructions, like roadway 14, a building, a river, or other obstacles. The tracking system 22 provides the operator with information about the downhole tool 24 such as depth, roll position, and pitch orientation. This information may be measured, collected and transmitted to the tracking system using an electronics package 30 supported within the downhole tool 24.

The electronics package 30 may comprise a transmitter 32 for emitting a signal through the ground. Preferably the transmitter 32 comprises a dipole antenna that emits a magnetic dipole field. The electronics package 30 may also comprise a plurality of sensors 34 for detecting operational characteristics of the downhole tool assembly 24 and the drill bit 18.

The plurality of sensors 34 may generally comprise sensors such as a roll sensor to sense the roll position of the drill bit 18, a pitch sensor to sense the pitch of the drill bit, a temperature sensor to sense the temperature in the electronics package 30, and a voltage sensor to indicate battery status. The information detected by the plurality of sensors 34 is preferably communicated from the downhole tool assembly 24 on the signal transmitted by the transmitter 32 using modulation or other known techniques.

One of skill in the art will appreciate that the slide cartridge design disclosed herein may be modified without departing from the spirit of the invention. The precise size, shape and placement of the slide cartridge on the carriage may be adjusted based upon the size and configuration of the HDD machine. While metal materials are anticipated to be preferred for the construction of the slide cartridge, certain plastics and ceramics may be utilized if strength requirements are met.

What is claimed is:

1. A machine comprising:

an elongate frame;

a rail supported on the frame having opposed first and second ends;

a carriage supported on the frame and moveable along the rail between the first and second ends;

a slide cartridge mounted on the carriage and configured to guide the carriage along the rail, the slide cartridge comprising:

a base member;

a channel having a pair of opposed walls that extend from the base member configured to engage the rail; and a rib formed on an outer surface of each of the opposed walls of the slide cartridge, the rib extending from the base member to a distal edge of the wall;

a rotary drive supported on the carriage; and a drill string having opposed first and second ends, the first end being operatively connected to the rotary drive;

in which the carriage has a mounting aperture configured to position the slide cartridge to engage the rail, the aperture having a notch formed to receive the rib.

2. The machine of claim 1 in which the slide cartridge further comprises a wheel supported by the base member and having an axis of rotation perpendicular to the channel.

3. The machine of claim 1, further comprising a plurality of wheels supported on the carriage and positioned to engage the rail.

4. The machine of claim 1 in which the slide cartridge comprises a wear member positioned above the rail and a wear member positioned below the rail.

5. The machine of claim 1 further comprising a thrust drive supported on the carriage and configured to drive movement of the carriage between the first and second ends of the rail.

6. A machine comprising:

a carriage frame having a base and a first cantilevered wall attached to the base;

a slide cartridge mounted on the first cantilevered wall, the slide cartridge comprising:

a base member;

a pair of opposed walls that extend from the base member configured to define a channel; and a rib formed on an outer surface of each of the opposed walls, the rib extending from the base member to a distal edge of the wall; and a carriage supported by the carriage frame defining a mounting aperture having a notch formed to receive the rib.

7. The machine of claim 6 further comprising a rail having opposed first and second ends, the opposed walls being positioned on opposing sides of the rail to guide movement of the carriage between the first and second ends.

8. The machine of claim 7 further comprising a plurality of rail engaging wheels mounted on the first cantilevered wall configured to roll the carriage along the rail.

9. The machine of claim 7 further comprising a thrust drive supported on the carriage and adapted to drive movement of the carriage between the first and second ends of the rail.

10. A machine comprising:

a carriage frame having a base and a first cantilevered wall attached to the base;

a carriage supported by the carriage frame;

a slide cartridge mounted on the first cantilevered wall, the slide cartridge comprising:

a base member; and a pair of opposed walls that extend from the base member configured to define a channel;

a rail having opposed first and second ends, the opposed walls being positioned on opposing sides of the rail to guide movement of the carriage between the first and second ends;

a thrust drive supported on the carriage and adapted to drive movement of the carriage between the first and second ends of the rail;

a spindle supported on the carriage; and an elongate drill string having a first end and a second end, the first end operatively connected to the spindle.

11. The machine of claim 10 further comprising a downhole tool operatively connected to the second end of the drill string.

* * * * *